US011426649B2

(12) United States Patent
Rynda et al.

(10) Patent No.: US 11,426,649 B2
(45) Date of Patent: Aug. 30, 2022

(54) SYSTEM AND METHOD FOR VERIFYING THE INTEGRITY OF A DECK OF PLAYING CARDS

(71) Applicant: AGS LLC, Las Vegas, NV (US)

(72) Inventors: Robert John Rynda, Las Vegas, NV (US); Terry Keith Walker, Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 519 days.

(21) Appl. No.: 16/387,895

(22) Filed: Apr. 18, 2019

(65) Prior Publication Data

US 2019/0321717 A1 Oct. 24, 2019

Related U.S. Application Data

(60) Provisional application No. 62/659,853, filed on Apr. 19, 2018.

(51) Int. Cl.

| | |
|---|---|
| ***A63F 1/12*** | (2006.01) |
| *A63F 1/00* | (2006.01) |
| *A63F 1/06* | (2006.01) |

(52) U.S. Cl.

CPC ..... *A63F 1/12* (2013.01); *A63F 1/067* (2013.01); *A63F 2001/001* (2013.01); *A63F 2001/005* (2013.01); *A63F 2250/1021* (2013.01); *A63F 2250/58* (2013.01)

(58) Field of Classification Search

CPC ..... A63F 1/12; A63F 1/14; A63F 1/067
USPC ..... 273/149 R
See application file for complete search history.

(56) References Cited

U.S. PATENT DOCUMENTS

| | | | |
|---|---|---|---|
| 1,955,926 | A | 4/1934 | Matthaey |
| 2,159,958 | A | 5/1939 | Sachs |
| 2,430,681 | A | 11/1947 | Johnson |
| 2,706,117 | A | 4/1955 | Notz |
| 2,711,319 | A | 6/1955 | Morgan |
| 2,714,510 | A | 8/1955 | Oppenlander |
| 2,717,782 | A | 9/1955 | Droll |
| 2,727,747 | A | 12/1955 | Semisch, Jr. |
| 2,753,185 | A | 7/1956 | Johnson |
| 2,755,090 | A | 7/1956 | Aldrich |

(Continued)

FOREIGN PATENT DOCUMENTS

| | | | |
|---|---|---|---|
| EP | 3194039 | A2 | 7/2017 |
| JP | 2001327647 | A | 11/2001 |

(Continued)

OTHER PUBLICATIONS

Images downloaded from Internet Mar. 5, 2019, 11 pages.

*Primary Examiner* — John E Simms, Jr.
(74) *Attorney, Agent, or Firm* — Crowell & Moring LLP

(57) ABSTRACT

A system and method of shuffling decks of cards is disclosed including verifying that the shuffled deck of cards has the same number of cards as the deck of cards had had when a manual verification process was performed at the initiation of use of the deck of cards. Using the measured weight of the deck of cards after completion of shuffling, the number of cards in the shuffled deck of cards is verified. A cut card may be introduced to reduce the possibility of exposing the hole card to view. Two decks of cards may be used in sequence so that a first deck of cards is being used to play the game of cards while the second deck of cards is being shuffled and verified.

24 Claims, 17 Drawing Sheets

(56) References Cited

U.S. PATENT DOCUMENTS 2,815,214 A 12/1957 Hall
3,067,885 A 12/1962 Kohler
3,147,978 A 9/1964 Sjostrand
3,305,237 A 2/1967 Granius
3,588,116 A 6/1971 Kosaburo
3,589,730 A 6/1971 Slay
D224,658 S 8/1972 Cole et al.
3,975,010 A 8/1976 Schisselbauer et al.
4,033,502 A 7/1977 Rothchild
4,151,410 A 4/1979 McMillan et al.
4,310,160 A 1/1982 Willette et al.
4,497,488 A 2/1985 Plevyak et al.
4,513,969 A 4/1985 Samsel, Jr.
4,515,367 A 5/1985 Howard
4,534,562 A 8/1985 Cuff et al.
4,586,712 A 5/1986 Lorber et al.
4,659,082 A 4/1987 Greenberg
4,770,421 A 9/1988 Hoffman
4,807,884 A 2/1989 Breeding
4,832,342 A 5/1989 Plevyak et al.
4,951,950 A 8/1990 Normand et al.
4,969,648 A 11/1990 Hollinger et al.
5,000,453 A 3/1991 Stevens et al.
5,096,197 A 3/1992 Embury
5,261,667 A 11/1993 Breeding
5,344,146 A 9/1994 Lee
5,356,145 A 10/1994 Verschoor
5,382,024 A 1/1995 Blaha
5,397,133 A 3/1995 Penzias
5,431,399 A 7/1995 Kelley
5,435,830 A 7/1995 Senda et al.
5,445,377 A 8/1995 Steinbach
5,575,475 A 11/1996 Steinbach
5,584,483 A 12/1996 Sines et al.
5,676,372 A 10/1997 Sines et al.
5,683,085 A 11/1997 Johnson et al.
5,692,748 A 12/1997 Frisco et al.
5,695,189 A 12/1997 Breeding et al.
5,718,427 A * 2/1998 Cranford ..... A63F 1/12 273/149 R
5,770,533 A 6/1998 Franchi
5,779,546 A 7/1998 Meissner et al.
5,944,310 A 8/1999 Johnson et al.
D414,527 S 9/1999 Tedham
5,989,122 A * 11/1999 Roblejo ..... A63F 1/14 273/149 P
6,019,368 A 2/2000 Sines et al.
6,068,258 A 5/2000 Breeding et al.
6,113,100 A * 9/2000 Mu ..... A63F 9/28 273/149 R
D432,588 S 10/2000 Tedham
6,139,014 A 10/2000 Breeding et al.
6,149,154 A 11/2000 Grauzer et al.
6,250,632 B1 * 6/2001 Albrecht ..... A63F 1/12 273/149 P
6,254,096 B1 7/2001 Grauzer et al.
6,299,167 B1 10/2001 Sines et al.
6,325,373 B1 12/2001 Breeding et al.
D465,082 S 11/2002 Hassett
6,568,678 B2 5/2003 Breeding et al.
6,588,750 B1 7/2003 Grauzer et al.
6,588,751 B1 7/2003 Grauzer et al.
6,629,894 B1 * 10/2003 Purton ..... A63F 1/06 273/149 R
6,651,981 B2 11/2003 Grauzer et al.
6,651,982 B2 11/2003 Grauzer et al.
6,651,985 B2 11/2003 Sines et al.
6,655,684 B2 12/2003 Grauzer et al.
6,659,460 B2 12/2003 Blaha et al.
6,676,127 B2 1/2004 Johnson et al.
6,698,756 B1 3/2004 Baker et al.
D488,193 S 4/2004 Girard
D490,481 S 5/2004 Hessing
6,886,829 B2 5/2005 Hessing et al.
6,889,979 B2 5/2005 Blaha et al.
6,952,542 B1 10/2005 Morikawa
6,959,955 B2 11/2005 Carter, III et al.
7,059,602 B2 6/2006 Grauzer et al.
7,073,791 B2 7/2006 Grauzer et al.
7,137,627 B2 11/2006 Grauzer et al.
7,234,698 B2 6/2007 Grauzer et al.
7,255,344 B2 8/2007 Grauzer et al.
7,300,056 B2 11/2007 Gioia et al.
7,322,576 B2 1/2008 Grauzer et al.
7,338,044 B2 3/2008 Grauzer et al.
7,341,510 B2 3/2008 Bourbour et al.
7,384,044 B2 6/2008 Grauzer et al.
7,413,191 B2 8/2008 Grauzer et al.
7,523,935 B2 4/2009 Grauzer et al.
7,523,936 B2 4/2009 Grauzer et al.
7,544,078 B1 6/2009 Liu et al.
7,556,266 B2 7/2009 Blaha et al.
7,568,489 B2 8/2009 Lee et al.
7,644,923 B1 1/2010 Dickinson et al.
7,661,676 B2 2/2010 Smith
7,702,635 B2 4/2010 Horvitz et al.
D615,600 S 5/2010 Scheper et al.
7,764,836 B2 7/2010 Downs, III et al.
7,766,332 B2 8/2010 Grauzer et al.
7,784,790 B2 8/2010 Grauzer et al.
7,815,189 B1 * 10/2010 Jenkins, Jr. ..... A63F 1/14 273/149 R
7,854,430 B2 12/2010 Toyama
7,897,424 B2 3/2011 Park
7,971,881 B2 7/2011 Toyama et al.
8,011,661 B2 9/2011 Stasson
D646,238 S 10/2011 Jang et al.
RE42,944 E 11/2011 Blaha et al.
8,109,514 B2 2/2012 Toyama
8,191,894 B2 6/2012 Grauzer et al.
D663,785 S 7/2012 Walsh et al.
8,210,535 B2 7/2012 Grauzer et al.
8,342,525 B2 1/2013 Scheper et al.
8,366,109 B2 2/2013 Soltys
8,419,521 B2 4/2013 Grauzer et al.
8,469,360 B2 6/2013 Sines
8,505,916 B2 8/2013 Grauzer et al.
8,511,684 B2 8/2013 Grauzer et al.
8,579,289 B2 11/2013 Rynda et al.
8,602,416 B2 12/2013 Toyama
8,616,552 B2 12/2013 Czyzewski et al.
8,628,086 B2 1/2014 Krenn et al.
8,646,779 B2 2/2014 Grauzer et al.
8,651,485 B2 2/2014 Stasson
8,702,101 B2 4/2014 Scheper et al.
8,720,892 B2 5/2014 Sines
8,777,710 B2 7/2014 Grauzer et al.
8,814,164 B2 8/2014 Baker et al.
8,820,745 B2 9/2014 Grauzer et al.
8,844,931 B2 9/2014 Blaha et al.
8,899,587 B2 12/2014 Grauzer et al.
8,944,904 B2 2/2015 Grauzer et al.
8,960,674 B2 2/2015 Stasson et al.
8,992,323 B2 3/2015 Kelly et al.
8,998,211 B2 4/2015 Grauzer et al.
9,153,093 B2 10/2015 Hartley
9,162,138 B2 10/2015 Grauzer et al.
9,220,971 B2 12/2015 Rynda et al.
9,220,972 B2 12/2015 Grauzer et al.
9,233,298 B2 1/2016 Sines
9,240,888 B2 1/2016 Crowder, Jr. et al.
9,259,640 B2 2/2016 Grauzer et al.
9,266,012 B2 2/2016 Grauzer et al.
9,320,964 B2 4/2016 Wadds et al.
9,333,415 B2 5/2016 Hessing et al.
9,339,723 B2 5/2016 Grauzer et al.
9,345,951 B2 5/2016 Czyzewski et al.
9,345,952 B2 5/2016 Blaha et al.
9,378,766 B2 6/2016 Kelly et al.
9,387,390 B2 7/2016 Downs, III et al.
D764,599 S 8/2016 Tedham
9,474,957 B2 10/2016 Haushalter et al.
9,504,905 B2 11/2016 Kelly et al.

(56) References Cited

U.S. PATENT DOCUMENTS

| | | | | |
|---|---|---|---|---|
| 9,511,274 | B2 | 12/2016 | Kelly et al. | |
| 9,539,494 | B2 | 1/2017 | Sines et al. | |
| 9,561,426 | B2 | 2/2017 | Grauzer et al. | |
| 9,566,501 | B2 | 2/2017 | Stasson et al. | |
| 9,616,324 | B2 | 4/2017 | Krenn et al. | |
| 9,623,317 | B2 | 4/2017 | Scheper et al. | |
| 9,633,523 | B2 | 4/2017 | Grauzer et al. | |
| 9,659,461 | B2 | 5/2017 | Grauzer et al. | |
| 9,679,603 | B2 | 6/2017 | Kelly et al. | |
| 9,700,785 | B2 | 7/2017 | Hessing et al. | |
| 9,713,761 | B2 | 7/2017 | Sampson et al. | |
| 9,717,979 | B2 | 8/2017 | Grauzer et al. | |
| 9,731,190 | B2 | 8/2017 | Sampson et al. | |
| 9,789,385 | B2 | 10/2017 | Blaha et al. | |
| 9,802,114 | B2 | 10/2017 | Krenn | |
| 9,811,671 | B1 | 11/2017 | Durst et al. | |
| 9,818,249 | B1 | 11/2017 | Fraser et al. | |
| 9,846,814 | B1 | 12/2017 | Fraser | |
| 9,849,368 | B2 | 12/2017 | Stasson et al. | |
| 9,861,880 | B2 | 1/2018 | Stasson et al. | |
| 10,124,241 | B2 | 11/2018 | Stasson et al. | |
| 10,226,686 | B2 | 3/2019 | Scheper | |
| 10,238,954 | B2 | 3/2019 | Stasson et al. | |
| 2002/0163125 | A1* | 11/2002 | Grauzer | G10L 19/07 273/149 R |
| 2003/0042673 | A1 | 3/2003 | Grauzer et al. | |
| 2003/0052449 | A1 | 3/2003 | Grauzer et al. | |
| 2003/0052450 | A1 | 3/2003 | Grauzer et al. | |
| 2003/0090059 | A1 | 5/2003 | Grauzer et al. | |
| 2003/0094756 | A1 | 5/2003 | Grauzer et al. | |
| 2004/0245720 | A1 | 12/2004 | Grauzer et al. | |
| 2011/0078096 | A1* | 3/2011 | Bounds | G06Q 99/00 705/500 |
| 2011/0079959 | A1* | 4/2011 | Hartley | G07F 17/3223 273/292 |
| 2011/0130185 | A1* | 6/2011 | Walker | G07F 17/3202 463/13 |
| 2014/0103608 | A1 | 4/2014 | Grauzer et al. | |
| 2015/0130132 | A1 | 5/2015 | Grauzer et al. | |
| 2015/0165306 | A1* | 6/2015 | Sines | A63F 1/12 273/149 R |
| 2015/0196833 | A1 | 7/2015 | Scheper et al. | |
| 2015/0209655 | A1 | 7/2015 | Stasson et al. | |
| 2015/0290529 | A1 | 10/2015 | Bourbour et al. | |
| 2016/0220893 | A1 | 8/2016 | Czyzewski et al. | |
| 2016/0236068 | A1 | 8/2016 | Wadds et al. | |
| 2017/0072293 | A1 | 3/2017 | Kelly et al. | |
| 2017/0216713 | A1 | 8/2017 | Scheper et al. | |
| 2018/0015357 | A1* | 1/2018 | Stasson | A63F 1/18 |
| 2018/0085658 | A1 | 3/2018 | Helsen et al. | |
| 2018/0089956 | A1 | 3/2018 | Nagaragatta et al. | |
| 2018/0243641 | A1 | 8/2018 | Sattar et al. | |
| 2018/0345122 | A1 | 12/2018 | Gunderson | |
| 2019/0060739 | A1 | 2/2019 | Stasson et al. | |

FOREIGN PATENT DOCUMENTS

| | | | |
|---|---|---|---|
| WO | WO2016044776 | A1 | 3/2016 |
| WO | WO2016018607 | A4 | 5/2016 |

* cited by examiner

SYSTEM AND METHOD FOR VERIFYING THE INTEGRITY OF A DECK OF PLAYING CARDS

The present application claims the benefit of U.S. provisional application Ser. No. 62/659,853, filed on Apr. 19, 2018, which is incorporated herein by reference in its entirety.

TECHNICAL FIELD

The present specification relates to manipulating decks of cards for table games.

BACKGROUND

Playing cards are used in a wide variety of games. When playing cards are used to play games in a casual setting, such as in the home, the cards may be processed manually. That is, the cards may be shuffled by hand.

In a casino environment is important to ensure that the cards being used to play the game of cards are not tampered with, that the cards are well shuffled, ensuring a high degree of randomization of the cards for each play of the game, and that the card handling and shuffling is expedited so that games can be played quickly. The speed with which an individual game of cards is played is economically significant, as the casino benefits from each completed game.

A number of card handling devices or shufflers have been devised. To facilitate thorough and quick shuffling of cards, various mechanical or electro-mechanical card shuffling devices are known. In addition, other types of card handling, shuffling, card counting, card verification, receiving, transporting and retaining devices have been developed.

In addition to randomization of the deck or decks of cards, the integrity of the deck of cards may be verified in order to ensure that the game is properly played. Deck integrity has been verified by counting the cards individually as an input card deck is processed to form the output deck or hands of cards. Counting the cards may be combined with identifying the suit and value of the card by imaging the face of the card or an indicia printed thereon and such identification may be used in conjunction with the shuffling mechanism to result in randomized card output sequences. Some of these techniques are incorporated into the design concept of a card shuffler, while others may be performed separately. The card imaging system may which may include a camera that acquires a digital image of at least a portion of the unique face of each card. An image recognition algorithm may be used to analyze the image and compare the image to images of cards of known identity that have been stored in a digital memory. Where the card image sufficiently corresponds to the stored image data, the identity of each card may be determined and used to verify the integrity of deck being shuffled, or to sort the deck of cards into a desired order.

The number of cards and values of cards required in a deck of cards differs amongst the different types of games of cards. The most common number of cards in a single deck of cards is 52, although such decks are usually supplied with one or more ancillary cards such as Jokers that may be discarded after the deck of cards is unpackaged and prior to use. Other games may use greater or lesser number of cards in the deck. Multiple decks of such cards may be used in some games such as Blackjack (21), Baccarat or Canasta. But where a single deck of cards is used for a game of cards, the number of cards in the deck and their values is expected to be known prior to the start of each game.

Shuffling of a deck of cards is a well-known process of preparing the deck of playing cards prior to distributing the deck of cards in accordance of the rules of a particular game being played. The specific approach taken to shuffling a deck of cards by mechanical means differs between various commercially available shufflers. To be acceptable to players of the game, and to any regulatory authority of a state, locality or national government the resultant shuffled deck of cards must meet a standard of "randomness".

The exact criteria for randomness are often not published by industry groups or regulating authorities, but compliance with a standard of "randomness" may evaluated by a certified testing authority such as GLI (Gaming Laboratories International, LLC, Lakehurst, N.J. 08703) or by other approved methods.

Herein, the terms "unshuffled" and "shuffled" relate to the state of the deck of cards prior to, and subsequent to, a mechanical shuffling process intended to "randomize". Suffice it to say, the state of "randomness" of the cards in a shuffled deck is at least perceived by the players of the game to deprive any player or the house of an unfair advantage when the game is played in accordance with the agreed rules. In commercially available products for use in regulated casinos, the state of "randomness" is defined, in practice, by the act of being certified as a card shuffler by the applicable regulatory authority or certified testing agent.

Devices for shuffling cards may shuffle cards for a plurality of games of cards; however the shuffler would be set up or adjusted for the particular game being played and associated with a deck or decks of cards of a fixed number of cards and card values. Without loss of generality, when a deck of cards is described herein, the deck of cards has the appropriate number of cards for the game of cards being played and having the required number of suits and values of cards in each suit; and, the shuffling apparatus for such a game may be configurable for the number of cards required. Since deck of 52 cards is used in many casino games, it may be convenient to use that specific number of cards in the examples herein.

One consideration in the mechanical design of a card shuffler is that playing cards are manufactured in various sizes, thicknesses, materials and surface finishes. This variance in card properties creates problems in designing and operating a card handling apparatus and card shufflers may process or shuffle only cards of a single size, such as the larger standard size or the smaller bridge size, or a range of card thicknesses without adjustment or recalibration. In other instances, the apparatus may require calibration for the specific type of cards to be used at the time.

Playing cards are substantially rectangular in plan view, with rounded corners, and may be of varying sizes and design, but in the United States there are two nominal sizes: "Poker" cards have planar dimensions of 3.5 inches (8.89 cm) long and 2.5 inches (6.35 cm) wide, while "bridge" cards have a length of 3.5 inches (8.89 cm) long by 2.25 inches (5.715 cm) wide. Card shufflers may be designed to handle one style of cards, or both styles of cards. While having the appearance of being of being a standard size, the tolerances on the planar dimensions as manufactured are fairly loose and there appears to be little actual standardization of thickness, weight, materials, or details of marking of card values. Broadly, cards are fabricated of a plastic or of paper with a plastic coating, with the former being more expensive, but in more general use as they are more durable. Bridge cards are often used in poker games as they may be easier to deal and to hold in hands and are less expensive.

In a sample of 95 decks of bridge and poker cards from several manufacturers, each being designated a different product style, card lengths ranged from 87.50 mm to 89.50 mm. In a sample of 28 decks of bridge-sized cards, widths varied from 56.98 mm to 58.25 mm. In a sample of 67 decks of poker-sized cards, widths varied from 62.44 to 63.54 mm. In the sample of predominantly plastic cards, decks of cards from differing manufactures and styles of the cards had a range of thicknesses from 12.72 mm to 17.50 mm and weighed from 0.075.8 kg to 0.1396 kg per deck of cards (54 cards, including the jokers.) These results were obtained from the Internet from a site "Home Poker Tourney" as "Playing Card Review," accessed on the Internet on Apr. 5, 2018.

A desirable aspect of a card shuffler is that, in addition to the randomization of the deck of cards by the shuffling function, the number of cards in the deck of cards is verified prior to the play of each game of cards.

Without suggesting that references cited in this section of the application represent more than a brief introduction for persons who are unfamiliar with the shuffler art, several patents illustrating approaches to the verification of a deck of cards, prior to playing a game of cards with the shuffled deck are briefly mentioned.

U.S. Pat. No. 9,539,494, issued on Jan. 10, 2017 to Randy D. Sines, et al. discloses a shuffler that randomizes cards of a plurality of cards by the cards by permitting cards to drop one-by-one through a slot capable of admitting one card at a time, and detecting each card passing through the slot. In some embodiments the thickness and the weight of the plurality of cards is measured prior to the shuffling process and compared with a known thickness and weight to validate the cards.

U.S. Pat. No. 9,153,093 issued on Oct. 6, 2015 to Peter Hartley, discloses an apparatus for using actual playing cards for online gaming where the shuffled cards are transferred from a deck of playing cards to a card holding position in a card holder so that an image of the each actual card may be obtained and transmitted for viewing by one or more on-line players. The deck of cards used in the game of cards is retained in the apparatus at all times and re-shuffled to start another game. The cards are weighed prior to the next shuffling process as a part of a process to determine whether the deck of cards remains suitable for playing the next game of cards.

U.S. Pat. No. 7,976,023 issued on Jul. 12, 2011 to Lynn Hessling et al., discloses a shuffler apparatus that obtains an image of each card that is dispensed by the shuffler and the image is used for various purposes including verification of the number of cards in the deck when the deck has been completely dealt by manually pressing a "verify" key.

U.S. Pat. No. 7,815,189 issued on Oct. 19, 2010 to Charles E. Jenkins, Jr., discloses a playing card handler that shuffles a single deck of cards after determining that the weight of a deck of cards inserted into the deck tray is substantially equal to the assumed weight of the deck of cards. Shuffled cards are dispensed as hands to a card tray.

A shuffler apparatus may also image the face of the card having indicia of suit and value or other indicia uniquely identifying a card of the deck of cards either for card verification alone or for the purpose of creating an output deck of cards having a particular, although random, arrangement of cards. In an aspect, such machines may also be programmed to arrange the cards of the output deck in a predetermined manner.

Often, the card counting and reading mechanism is an integral part of the shuffler concept and operation and is performed at a stage in the shuffling process prior to forming the output deck of cards or hands of cards. While this approach has been deemed acceptable, the validation step was performed prior to the shuffling of the deck of cards or the formation of the hand. A loss of a card within the machine may occur without detection.

Another approach to validating the number of cards of a deck of cards may be to image a side edge of the deck of cards once the output deck of cards has been assembled. Optical recognition techniques may be employed to count the transitions between the cards of the assembled deck so as to count the cards of the deck. However, the thickness of the cards of the deck of cards used may vary, as described above, and a counting approach needs to be easily adaptable to different card thicknesses and varying visibility of edge transitions. Damage to the cards during play, such as warping, bending, nicking and marring of the edges, and the known difference in thickness of the cards when obtained from differing sources or differing styles from the same source, make the calibration and reliability of such optical methods problematic.

There may also be a concern that the bottom card ("hole card") in a deck of cards that has been shuffled and is being used to deal a game of cards, may be inadvertently exposed to one or more players, providing an advantage in estimating the odds of a particular group of cards in a hand of cards. This may be mitigated by the physical design of the card shuffling or card dispensing apparatus, or by the use of a "cut card". A cut card is a card having the same nominal planar dimensions a card of the deck of cards being used in the game of cards and differing from the cards of the deck of cards in an obvious manner. For example, the card may be of a solid color, have advertising matter printed on at least one of the faces of the card or other markings that clearly distinguish the cut card from the cards of the deck of cards. At some juncture in the process of shuffling the deck and preparing the deck of cards for play, the cut card is located at the bottom of the deck to prevent the hole card from being viewed. Using a cut card is a different process than "cutting" the deck of cards prior to play, where the deck of cards is, for example, manually separated into an upper portion and a lower portion and the position of the portions interchanged to re-form the deck. The cut card may be used in addition to cutting the deck or in place of the cutting procedure when an automated shuffler is used.

Efficiency in shuffling cards facilitates playing more games of cards in a period of time and is more profitable to the casino. A shuffler that processes a second deck of cards while the first deck of cards is being used to play a game of cards as well as verifying that the shuffled deck has the correct number of cards is beneficial.

SUMMARY

A system to prepare a deck of cards for play of a game of cards is disclosed, comprising: a shuffler that accepts a deck of unshuffled playing cards in a card receiving area and manipulates the accepted deck of cards to produce a shuffled deck of cards having a randomized sequence of cards and to deposit the shuffled deck of cards in a card dispensing area. The shuffler may receive a first deck of cards and a second deck of cards in sequence and individually process each deck of cards repetitively for use in successive games of cards.

The shuffler may further include: a microprocessor having a computer-readable memory; and, a scale positioned in the card dispensing area, and be capable of receiving cards of the first deck of cards or the second deck of cards. A weight of the first deck of cards and a weight of the second deck of cards is determined when each of the first deck of cards and the second deck of cards is manually verified and first shuffled; and, a manually verified first deck weight and a manually verified second deck weight stored in the computer-readable memory. Alternatively the weight of a card of the deck of cards may be determined for each of the first and the second deck of cards and stored in the computer—readable memory. Further, each time the first deck of cards or the second deck of cards is subsequently shuffled, the weight of the first deck of cards or the second deck of cards, respectively, is determined using the scale and compared to the stored first verified deck weight or the stored second verified deck weight, respectively, and the microprocessor selects between a state of verified or not verified. where the state of "verified" is selected when a difference between the measured deck weight and the stored verified deck weight for the first deck or the second deck, respectively, is within a predetermined limit; and, a state of "not verified" is selected when the difference between the measured deck weight and the stored verified deck weight for the corresponding deck exceeds the predetermined limit in magnitude.

Alternatively, the stored weight of a card of the deck of cards may be used to determine the number of cards in the deck of cards being verified.

In another aspect, a method of verifying decks of shuffled cards for playing a card game is disclosed, comprising the steps of: providing a shuffler for randomizing a deck of cards for use in a game of cards, the shuffler being an electromechanical apparatus including a microprocessor, a computer readable memory and a card dispensing or output area, the card output area having a scale for determining the weight of cards in communication with the microprocessor; accepting the deck of cards by the shuffler; operating the shuffler to randomize the deck of cards; transferring the randomized deck of cards to the card output area; determining a net measured weight of the randomized deck of cards using the scale; determining a difference between the net measured weight of the randomized deck of cards and a predetermined calibration weight (the first or the second stored verified deck weight, or the first or the second stored single card weight, respectively); and, selecting between one of: a first state of "verified" or a second state of "not verified" based on determining that the difference between the net measured weight and the predetermined calibration weight does not exceed a predetermined test value or exceeds the predetermined test value in magnitude, respectively, or that the number of cards in the deck of cards does not differ from the value used to compute the weight of an individual deck of cards during the initialization process.

The predetermined test value may be selected so that variation in the weight of each deck is less than about half the weight of a card of the deck of cards. The net measured weight may be determined by measuring the scale reading when there are no cards present on the scale as a tare weight and subtracting the tare weight from the weight measured when there are cards on the scale. Where the weight of an individual card is used for verification purposes, the number of cards in the deck being verified needs to be equal to the value used to compute the individual card weight for each of the decks. Where a cut card is used, a modified tare weight may be determined by the scale when a card is determined to be present on the scale and the tare weight is approximately equal to the weight of a cut card.

DETAILED DESCRIPTION

Figure 1:
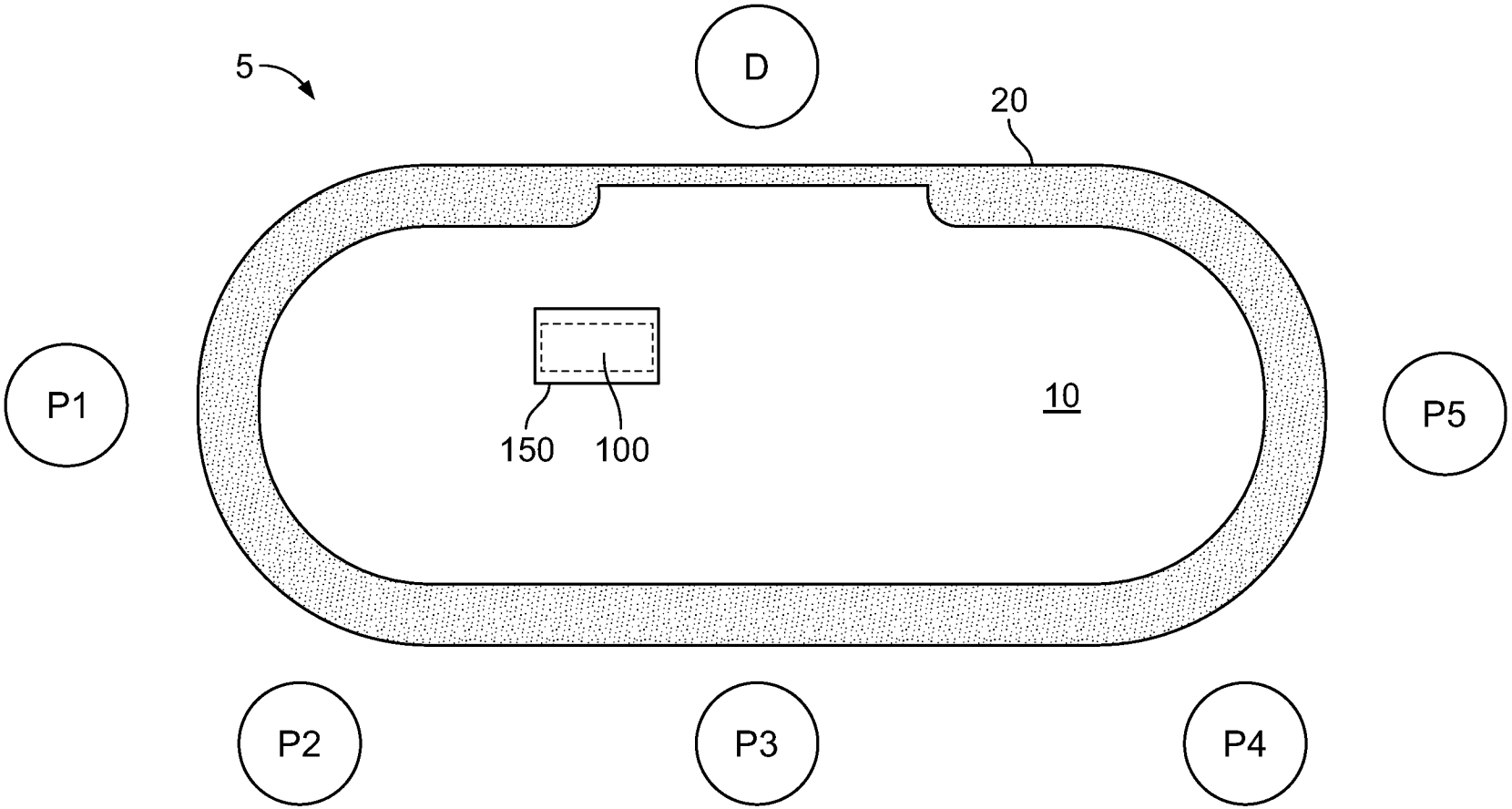
FIG. 1 is a plan view of a gaming table showing indicative positions of a dealer and players of a game of cards and a shuffler positioned in an aperture in a table top.

Exemplary embodiments may be better understood with reference to the drawings, but these embodiments are not intended to be of a limiting nature. Like numbered elements in the same or different drawings perform equivalent functions.

It will be appreciated that the methods described and the control of the apparatus shown in the figures may be embodied in machine-executable instructions, e.g. software, or in hardware, or in a combination of both. The machine-executable instructions can be used to cause a general-purpose computer, a special-purpose processor, such as a DSP, array processor, microprocessor or the like, that acts on the instructions to perform functions and actions described herein, operating as a particular machine.

Alternatively, the operations might be performed by specific hardware components that may have hardwired logic or firmware instructions for performing the operations described, or by any combination of programmed computer components and custom hardware components, which may include analog circuits, electromechanical components, or the like. The computer components may include Application Specific Integrated Circuits (ASIC), Field Programmable Gate Arrays (FPGA), or the like which may exist or are being developed and have the capability of configurable logic.

The methods may be provided, at least in part, as a computer program product that may include a non-volatile (non-transient) machine-readable medium having stored thereon instructions which may be used to program a computer (or other electronic devices) to perform the methods, including the control and sensing of the operation of mechanical components. For the purposes of this specification, the terms "machine-readable non-transient storage medium" shall be taken to include any medium that is capable of storing or encoding a sequence of instructions or data for execution by a computing machine or special-purpose hardware and that may cause the machine or special purpose hardware to be operable to perform any one of the methodologies or functions of the present invention and which retains the data stored when the power to the device is interrupted. The term "machine-readable medium" shall accordingly be taken include, but not be limited to, solid-state memories, optical and magnetic disks, magnetic memories, and optical memories, as well as any equivalent device that may be developed for such purpose.

For example, but not by way of limitation, a machine readable medium may include read-only memory (ROM); random access memory (RAM) of all types (e.g., S-RAM, D-RAM. P-RAM); programmable read only memory (PROM); electronically alterable read only memory (EPROM); magnetic random access memory; magnetic disk storage media; Flash memory, which may be NAND or NOR type; memory resistors; or electrical, optical, acoustical data storage medium, or the like. A volatile memory device such as DRAM may be used to store the computer program product provided that the volatile memory device is part of a system having a power supply, and the power supply or a battery provides power to the memory circuit for the time period during which the computer program product is stored on the volatile memory device.

For purposes of claim interpretation, the storage memory for storing a computer program product (including software, computer programming instructions, or "code") is "non-transient," where such a definition is given the broadest interpretation in terms of applicable memory types and techniques consistent with governing case law. Functions that are performed by a computer operable to process and execute the code may be equivalently performed by an electronic circuit that performs the same or similar acts.

Furthermore, it is common in the art to speak of software, in one form or another (e.g., program, procedure, process, application, module, algorithm or logic), as taking an action or causing a result. Such expressions are merely a convenient way of saying that execution of the instructions of the software by a computer or equivalent device causes or configures the processor of the computer or the equivalent device to perform or control an action or a produce a result, as is well known by persons skilled in the art.

When describing a particular example, the example may include a particular feature, structure, characteristic, or method step, but every example may not necessarily include the particular feature, structure, characteristic, or method step. This should not be taken as a suggestion or implication that the features, structure or characteristics of two or more examples should not or could not be combined, except when such a combination is explicitly excluded. When a particular feature, structure, or characteristic is described in connection with an example, a person skilled in the art may give effect to such feature, structure, or method step characteristic in connection with other examples, whether or not explicitly described.

To provide an example of a card shuffler which may be modified to use the disclosed approach of verifying the number of cards in the deck of cards that has been shuffled, a brief a description of some of the functions performed by such a shuffler is provided, as disclosed in U.S. Pat. No. 8,602,416, to H. Toyama, issued Dec. 10, 2013, entitled Card Shuffling Device and Method" and U.S. patent application Ser. No. 15/442,416, filed May 31, 2017, entitled "Trap Door Mechanism For Card Handling Devices Such As Card Shufflers," and the contents of each document are incorporated herein by reference in their entirety. However, the apparatus and method of verifying the integrity of a deck of playing cards is applicable to other configurations of card shufflers and various other card handling devices, as would be understood by a person of skill in the art. Herein, the use of the apparatus and technique is described for a shuffler intended to randomize one or more individual decks of cards in the shuffling operation. Shufflers that process a plurality of decks of cards as a group may also employ the techniques disclosed herein. Thus, in interpreting the term "shuffler", the shuffler may be any electromechanical mechanism capable of "randomizing" one or more decks of cards. The shuffler accepts a complete deck of cards in a card receiving or input area and presents a randomized verified complete deck of cards in a card dispensing or output area after the shuffling operation and the validation of the shuffled deck of cards as described herein.

An example of a shuffler apparatus 100, mounted to the upper surface 10 of a poker table 5 through an aperture 150 is shown in FIG. 1, where positions for the dealer D and the players, P are suggested with respect to a cushioned surround 20 of the table top.

Figure 2A:
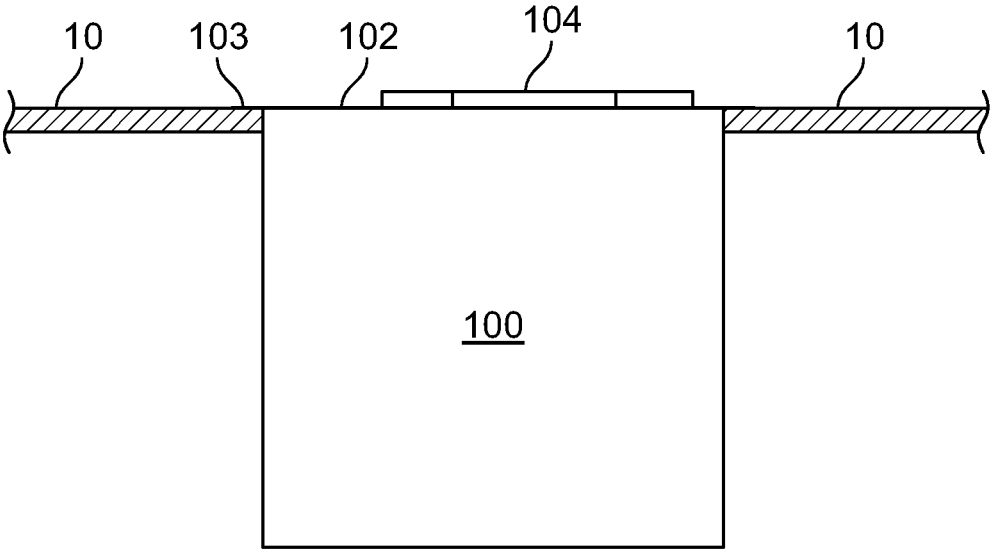
FIG. 2A is an elevation cross section view of an example of card shuffler suspended in an aperture in the table top by a flange and providing access to the card receiving and dispensing area through a cover (shown in closed position)

The exterior of an exemplary shuffler 100 is shown in FIG. 2A, in a vertical cross-section view as flush mounted to the top of the table 10, through an aperture 150 that has been formed therein. The table 5 may be of any type suitable for players of a game of cards. Other shufflers using the verification technique and method may be intended for mounting atop the table or partially or fully inserted in an aperture in the table top. The shuffler may have a lip 103 around the outer periphery thereof as an extension of the top surface 102 of the shuffler so as to support the shuffler with the top surface 102 thereof substantially flush with the table top 10, while concealing lower portion of the shuffler 100 from view by the players.

Figure 2B:
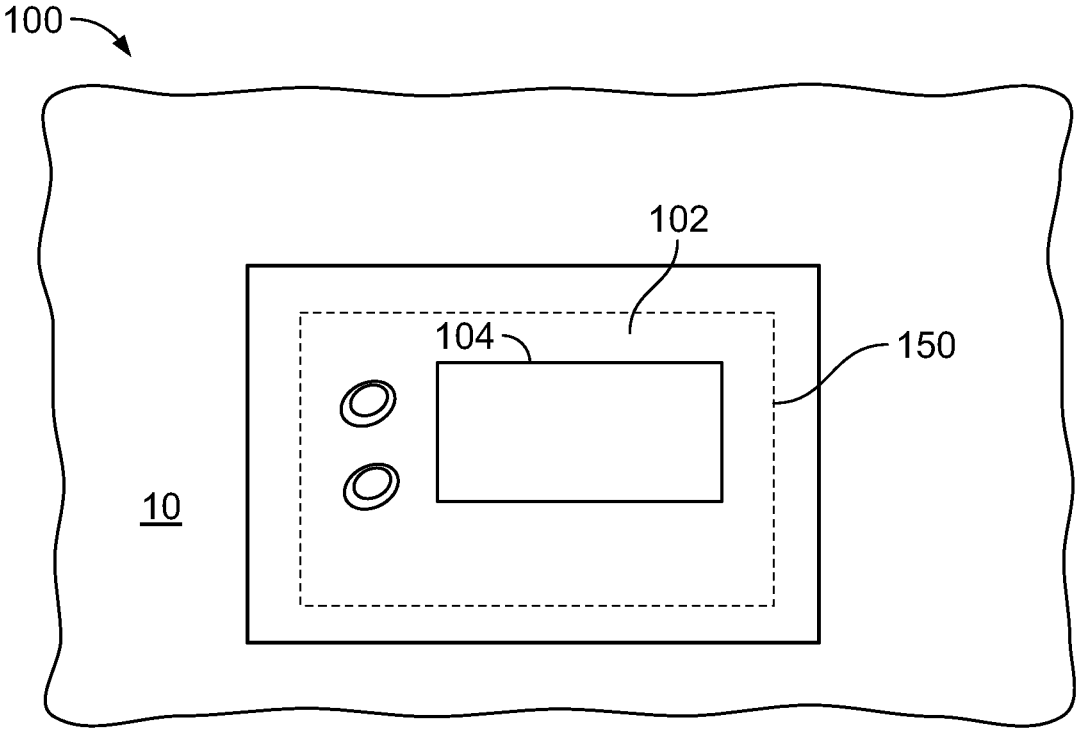
FIG. 2B is a plan view of the example card shuffler.

As shown in FIG. 2A, the shuffler 100 may be provided with an electromechanically actuated door or lid 104 that may serve to conceal card receiving or dispensing areas recessed into the top of the shuffler 100 when the cards are being shuffled and prior to making the shuffled cards available to the dealer. As shown in FIG. 2A, the lid 104 is slightly above the top surface 102, for clarity; however, the lid 104 is often designed so as to be flush with the top surface 102 when in the closed position, so that cards may be slid freely from the top surface of the table 10 across the surface of the top surface of the table and the top surface 102 of the shuffler 100, when the lid 104 is in a closed position. FIG. 2B shows a plan view of the shuffler 100 as mounted to the table top 10 through the aperture 150. One or more buttons such as 410, 420 may be provided as operator controls, and the buttons may be illuminated under program control as status indicators, The buttons 410, 420 may be slightly recessed in the top surface 102 to prevent inadvertent actuation, and be either touch sensitive or movable in response to the operator actions. An optional alphanumeric or graphical display 750 may be used to further operator control of the shuffler 100 and may be a touch-sensitive graphical display or other display type.

The internal details of the specific shuffling mechanism of the shuffler 100 are not shown in FIG. 2 A, B, but are more particularly described in patent and patent application incorporated by reference above. Some of the internal details and the operation of the shuffler 100 are described herein so as to provide context for the description of the verification technique and method; however, the apparatus and method may be employed with a variety of types of card shuffling apparatus. Many of the associated belts, motors, sensors, and the like, that are associated with providing the motive force and control inputs needed for the functioning of the overall apparatus are omitted here for clarity. The operation of an electromechanical shuffler such as that of the example is under the control of programmable logic, which may be a combination of discrete components, integrated circuits, a microprocessor executing a software program product, or the like. Nothing herein is intended to preclude a completely digital or a completely analog control system. Many electromechanical shufflers use a microprocessor-based approach, where the microprocessor executes a set of computer commands or instructions that have been stored in a non-transient digital memory so that the microprocessor performs the desired functions. Both volatile and non-volatile memory components may be used for data storage and computational purposes, depending on the specific function being performed, as would be understood by a person of skill in the art. Where analog signals are sensed or output for control or other purposes analog-to-digital converters (ADC) of digital-to-analog converters (DAC) may be used as needed.

Figure 3:
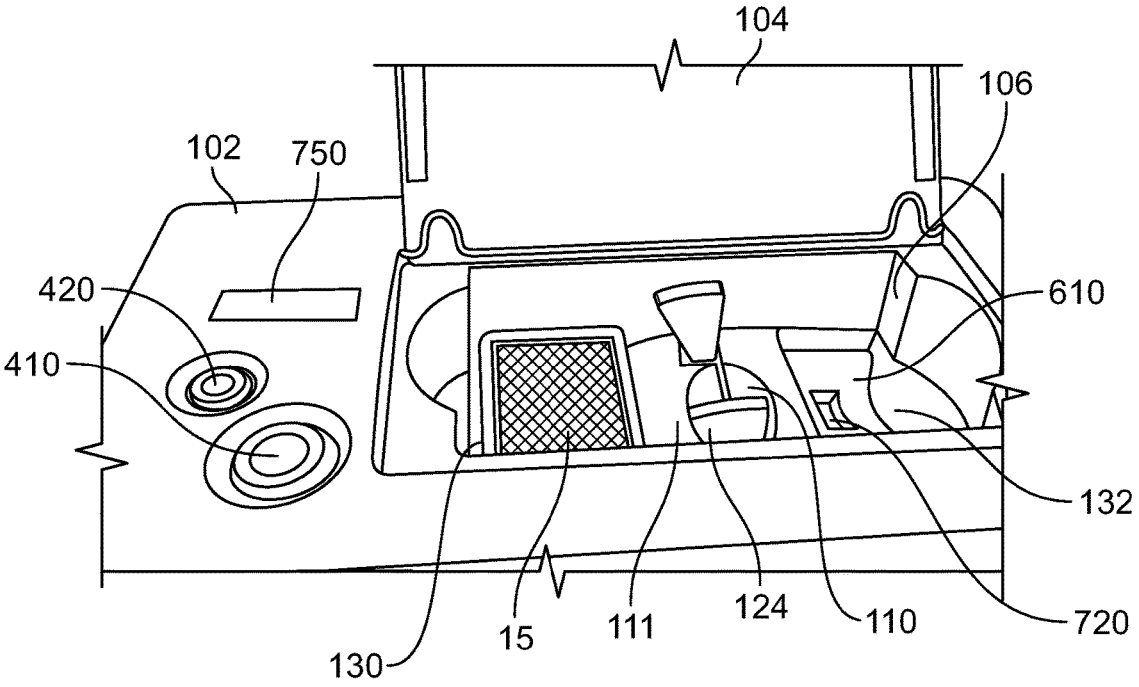
FIG. 3 is a perspective view showing the top of the card shuffler with the access cover open and a deck of cards positioned in the area for receiving an unshuffled deck of cards.

Control of the operation of the shuffler may be through the use of functional buttons or switches such as 410, 420, and the sensing of the presence of a deck of cards in a specific location by optical or mechanical techniques as described herein; for example, operator interaction with an alphanumeric display 750 as shown in FIG. 3, which may have color or graphical capabilities and sound alerts, a haptic feedback or input sensor, or the like.

As illustrated in FIG. 3, which is a partial top perspective view of the shuffler of FIG. 2A and FIG. 2B, a deck of cards 15 to be shuffled may be introduced into the apparatus 100, or be removed from the apparatus 100. The aperture 106 comprises a region, such as a recessed area, which serves as a card receiving or input area 130 for accepting and unshuffled deck of cards and a card dispensing or output area 132 making a shuffled deck of cards available for use.

When the cover plate (lid) 104 is in an opened state, as shown, a user, who may be a dealer, may place a deck of unshuffled cards 15 into a receiving area 130 at the aperture 106, so that the cards rest on a support surface within the apparatus 100 with faces of the cards having indicia of suit and value of each card of the deck of cards 15 facing downward and in a horizontal attitude. For reference purposes, the state of the cards after being introduced into the receiving area 130 is considered to be unshuffled and termed state A.

Figure 4:
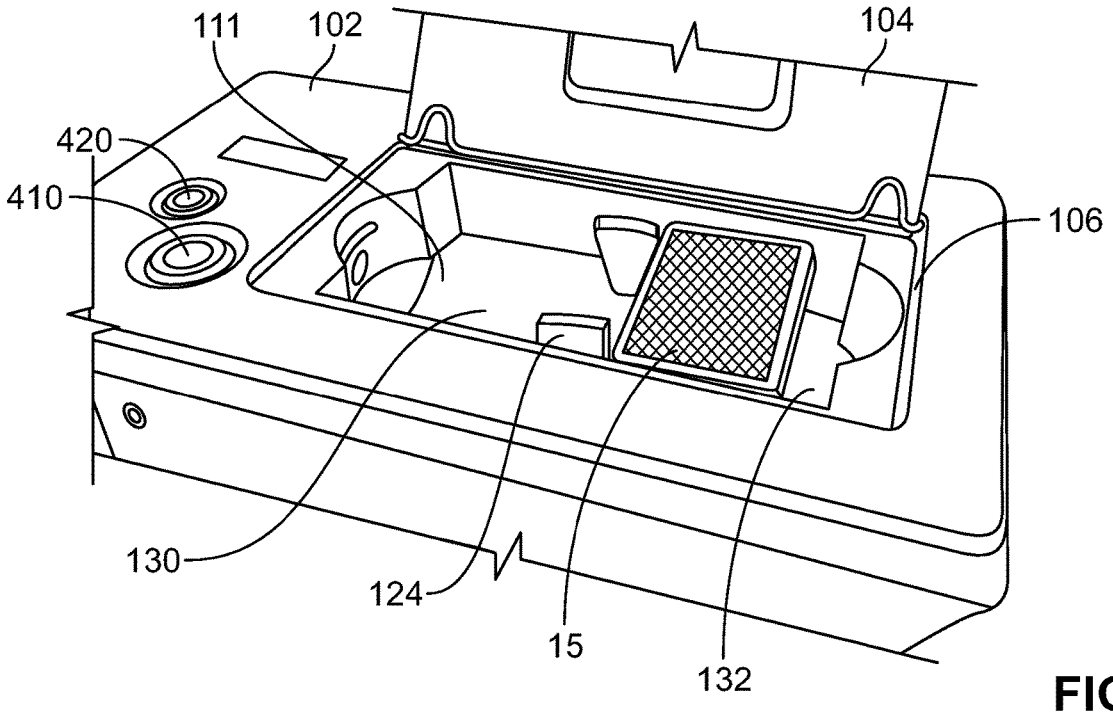
FIG. 4 is a perspective view similar to that of FIG. 3, and showing a deck of shuffled cards in an area where the deck of cards may be removed by the dealer.

After the cards have been shuffled and verified, termed state C, the deck of cards 15 is located at dispensing area 132 as shown in FIG. 4, and the lid 104 may be open to permit the removal of the deck of cards 15. As will be described later, a protocol for operating the shuffler 100 may be that an deck of cards in state A is placed in the receiving area 130 prior to removing the shuffled deck of cards in state C from the dispensing area 132. In such a configuration, two different decks may be individually processed and used repetitively in sequential order as successive games of cards are played, using the shuffler to expedite the process of preparing verified shuffled decks. FIG. 4 shows the receiving area 130 void of cards so that the support surface 111, which may be a trap door, may be seen.

The deck of cards 15 placed in the receiving area 130 at state A may be introduced into the portion of the shuffler that performs the card shuffling action by causing the deck of cards to fall into the shuffling compartment 128 (shown in FIG. 5) through a trap door 111. In the present example, the cards are introduced into the shuffling compartment 128 by rotationally opening the trap door 111 that supported the cards of the deck of cards when initially introduced into the shuffler 100. The action of the trap door 111 results in the introduction of all of the cards that have been placed on the trap door 111 of the receiving compartment into the shuffling compartment 128.

A simplified vertical cross-section of the shuffler 100 having a card shuffling compartment 128, shown in FIG. 5, disposed below the support surface (trap door) 111 of the receiving area 130 and dimensioned such that, when the deck of cards 15 is introduced into the shuffling compartment 128 from the receiving area 130, the orientation of the cards of the deck of cards may be constrained such that the face of a card is translated to be substantially parallel to a gravity vector when located in a position of the shuffling compartment 128 where shuffling can be performed. Other shuffler designs may process the cards of the deck of cards with the plane of the cards orthogonal to the gravity vector or may process the cards of the deck of cards in an individual manner. The specific description of the shuffler and the method of shuffling cards is for illustrative purposes and is not intended to limit the scope of the verification technique or method.

The deck of unshuffled cards 15 in state A, is supported by a trap door 111, at the bottom of the receiving area 130, rotatable about an axle or hinge 560 and supported in a horizontal aspect by latch mechanism 510, 512, 514, 516, 518 (collectively latch 520)

An elevator mechanism 142, not shown in detail, may have a surface facing the aperture 106 in the shuffling compartment 128 and is shown in a lowered position and when the trap door 111 is opened, the cards of the deck of cards freely fall to the bottom of the shuffling compartment. In an alternative, the elevator 142 may be positioned in a raised state, so as to receive the deck of cards into the shuffling compartment 128 without the deck of cards 15 falling the full extent of the shuffling compartment 128, and to then lower the deck of cards 15 further to begin performing the shuffling operation.

A gate 124, shown in the form of a pair of spaced sweeper arms is movable, such as by being rotatable about shaft or hinge 502, from a vertical position, as shown, to a position about 180 degrees opposed thereto (pointing downward), depending on the state of the shuffling apparatus. A position of the gate 124 where the arms are horizontal may also be used during certain states. The spacing between the two arms of the gate 124 may be dimensioned so that the arms may be positioned beneath the deck of cards 15 so as to support and urge the deck of cards from the shuffling compartment 128 to the dispensing area 132. In order avoid interference with the elevator operation, the dimension of the elevator platform in the same direction as the spacing between the two arms of gate 124 is less than that of the spacing between the two arms of gate 124.

Depending of the operational sequence of events, the lift gate 124 may be in either a upper or lower position with respect to the card receiving area 130 and either above or below the platform of the elevator 142. When inserted in the shuffler 100, in state A, a complete deck of unshuffled cards 15 rests on the trap door 111. The positioning of the gate 124 at this time may be as shown in FIG. 5 such that the gate 124 does not interfere with the insertion of cards 15 into the receiving area 130 or the transfer of the cards 15 into the shuffling compartment 128.

A trap door mechanism 111 may be used to move cards from the card receiving area 130 to the shuffling compartment 128. The trap door 111 may move between at least a first card supporting position shown in FIG. 5 where a top surface of the trap door 111 is held in a generally horizontal position forming the bottom surface of the card receiving area 130, and a second position where the trap door 111 swings into a generally vertical position where the cards are no longer supported by the trap door 111 and fall downwardly into the shuffling compartment 128 (FIG. 6).

To begin shuffling the cards, the trap door 111 is unlatched by latch mechanism 518 to permit the deck of cards 15 to fall, or, alternatively, be transported by the elevator mechanism 142 (or other card guide or transport mechanism), into the compartment 128. The trap door 111 may be controlled by a series of switches, motors, pulleys, and/or belts as is now known or later developed and may move in various manners (swing, rotate, slide, or the like). Other suitable mechanisms may also be used to transfer the cards from the receiving area 130 to the compartment 128 depending on the physical arrangement of the components and the shuffling concept.

Figure 5:
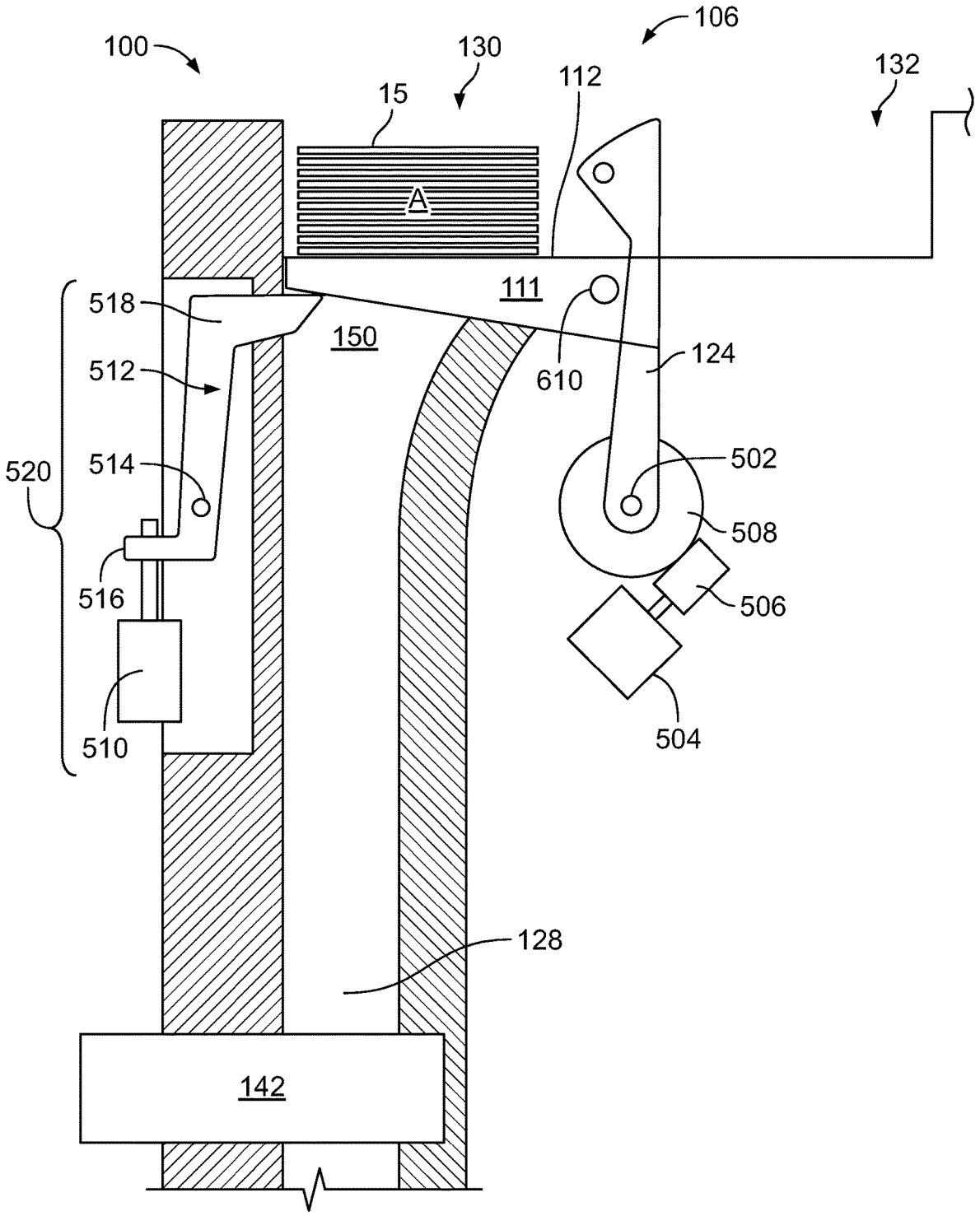
FIG. 5 is a cross-section of the example shuffler with the deck of cards in the position corresponding to FIG. 3.
Figure 6:
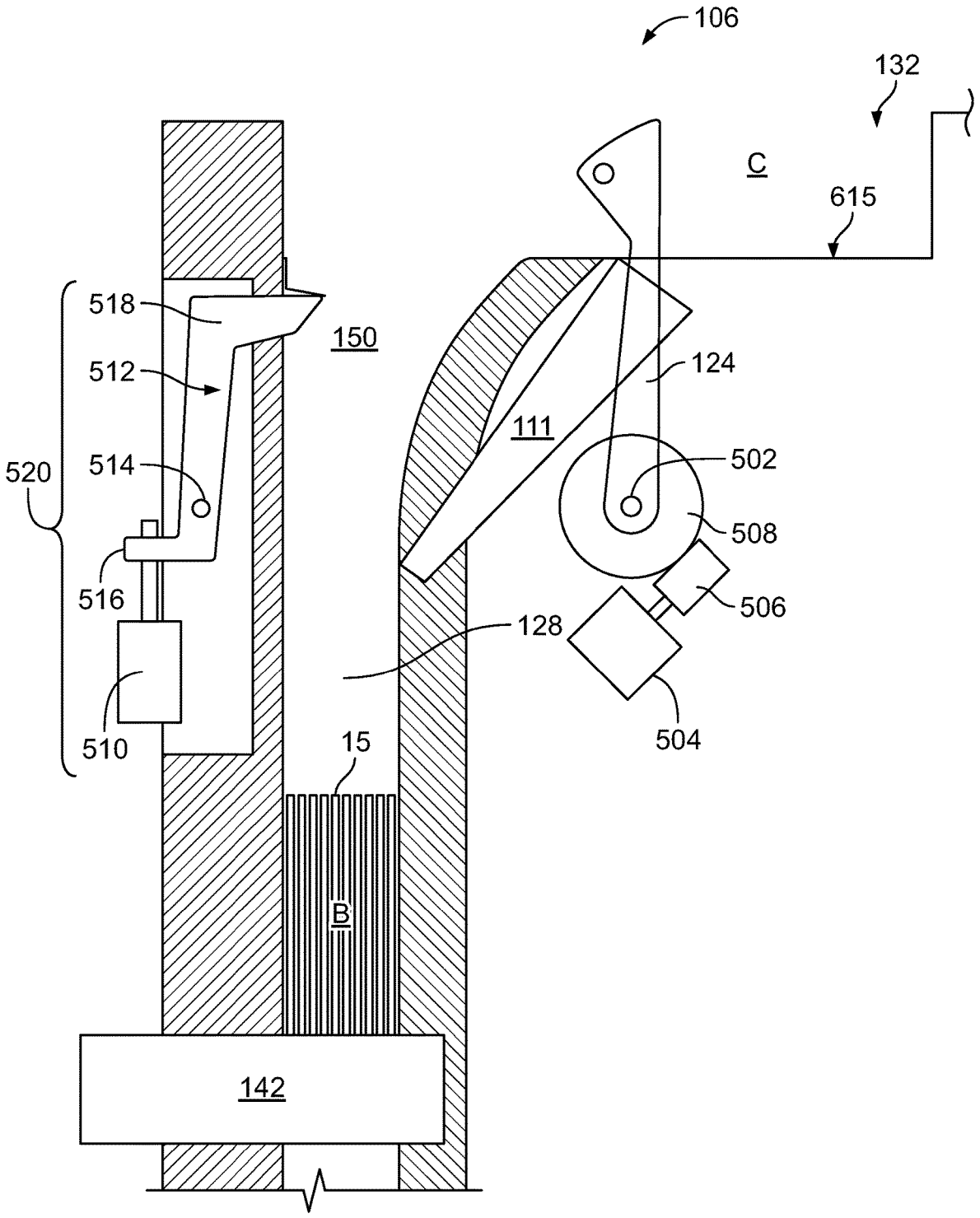
FIG. 6 is a cross-section of the example shuffler with the deck of cards in the shuffling compartment.

Movement or actuation of the trap door 111 may be performed with a trap door latching system 520 which, in the example illustrated in FIGS. 5 and 6, includes a solenoid 510, a latch 512 having a first end 516 and a second end 518, and which is rotatably mounted, such as about a hinge 514. The movement of the gate 124 between the upper and lower position orientations may be coordinated with the operation of the trap door 111 so as not to interfere with the motion of the cards and to position the gate 124 so as to cooperate with a the elevator 142 when the elevator 142 has been raised from a lower position after completion of the randomization process portion of the shuffling. The gate 128 may rotated to the vertical position so as to continue to transport the cards to the card dispensing area 132. The trap door 111 may be rotated about one end of the door.

Operation or movement of the trap-door mechanism and initiation of the shuffling process may be controlled or triggered by some event. For example, in one embodiment, the card handling mechanism, such as the shuffler 100, may include a "start" or "shuffle" button (e.g., 410) or the like. When a user provides input to that button (such as by depressing or touching it), the top cover 104 may be electromechanically rotated to a closed position and a signal may be sent directly to the trap door latch mechanism 520 to release the trap door 111. In other embodiments, such a user input might be transmitted to a controller, or processor, such as a microprocessor which, in turn, may generate and send one or more control signals (such as to the trap door solenoid and gate motor). Of course, other control schemes may be used to selectively control the operation of the trap door mechanism (including the gate, if present).

The gate 124 may be maintained in the vertical position to form a divider between the card receiving area 130 and the card dispensing area 132, as shown, or rotated to an approximately horizontal position to establish an upper limit to the height that the cards of the deck of cards 15 may attain during the actual shuffling operation. The randomization step of the shuffling operation is not described in detail herein, but may be found in the incorporated references. In principle, the randomization step, in this example, comprises ejecting groups of cards of the deck of cards in a vertical direction and permitting the ejected cards to return to a rest position on the elevator platform. In the present example, the cards of the entire deck of cards are processed substantially simultaneously during the time period that the cards are being ejected in the vertical direction while being confined in the shuffling compartment 128. After completion of the shuffling process, the deck of cards meets the product randomization requirements and is in state B.

The gate 124 may be rotated to a position approximately 180 degrees from the position of state A and the elevator 142 may then be then actuated to lift the shuffled deck of cards 15 so that the arms of the gate 124 extend below the bottom of the deck of cards 15 on the elevator platform. The gate 124 may then be rotated back to the original vertical position and to urge the cards of the deck of cards 15 into the dispensing area 132 on surface 610.

Various mechanisms may be used to move arms of the gate 124. For example, the position of the gate 124 may be controlled via a worm gear drive. In another example, the gate 124 may have an axle 502 that is attached to a gear 508. A motor 504 may drive a worm gear 506 to rotate the gate 124. Alternatively a stepping motor may be used to perform rotational actions or a belt drive may be used.

Thus, after the cards have been shuffled and are in state B, the cards are conveyed to a position (state C) in the dispensing area 132 within the aperture 106 so as to be supported by a support plate 610. The trap door 111 may also rotated back to a horizontal position and latched in the horizontal position by latch 518. This reset of the trap door 111 may be performed after the deck cards 15 is positioned in the dispensing area 132 or be performed in conjunction with the rotation of the gate 124. If the cards are being shuffled without verification, once the deck of cards is in state C, the lid or door 104 may open, and the deck of cards 15 may be manually removed from the dispensing area 132 of shuffler 100 by the user.

In an aspect, the verification of the integrity of a shuffled deck of cards may performed by weighing the deck of cards 15 after the cards have been shuffled and moved to the location identified as state C on the support surface 610. Herein, "verification of the integrity" or "verification" of a deck of cards comprises the act of determining that, after shuffling and prior to being removed from shuffler, the deck of cards contains the required number of cards for playing the game of cards. The same meaning is intended where the technique is used with shufflers processing a plurality of decks of cards, where the number of cards expected is the total number of cards of the decks of cards. Optionally, the verification process may also comprise verification that the bottom card of the deck of cards is a "cut" card.

Figure 7A:
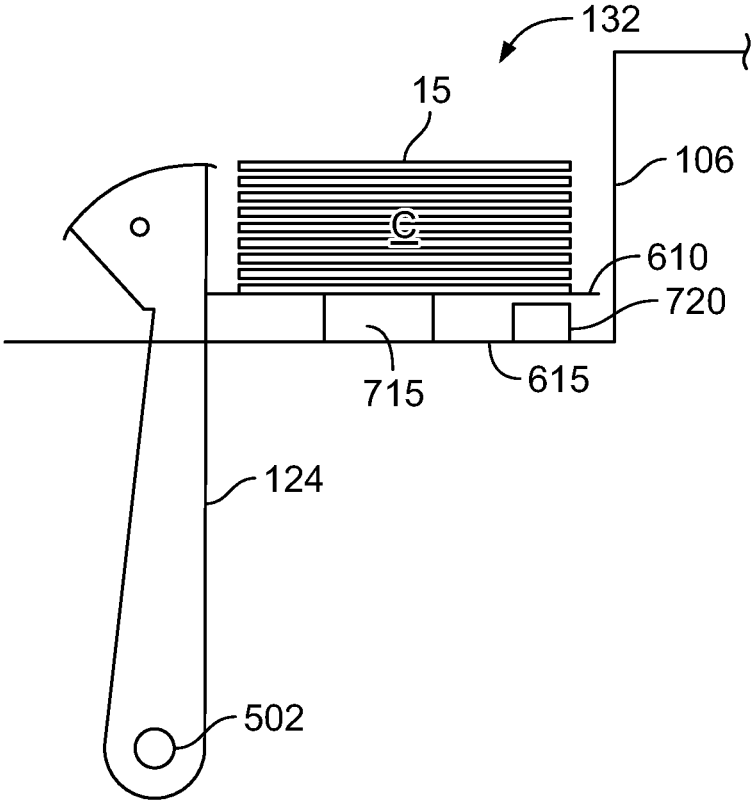
FIG. 7A is a detail cross-section view showing the deck of cards in the card removal area and positioned on the scale.

A detail of the dispensing area 132 is shown in FIG. 7A, where the dispensing area is bounded on one side by the raised arms of the gate 124 and on the other by a side of the aperture 106. The support surface 610 is positioned atop the load cell 715 and is supported by the lower surface 615 of the card dispensing area 132. The deck of cards 15 is shown in position on the weighing platform 610. The combination of the weighing platform 610, the load cell 715 and associated electronics, such as an analog-to-digital converter and data processing by a microprocessor, may be broadly described as an electronic scale or "scale".

Figure 7B:
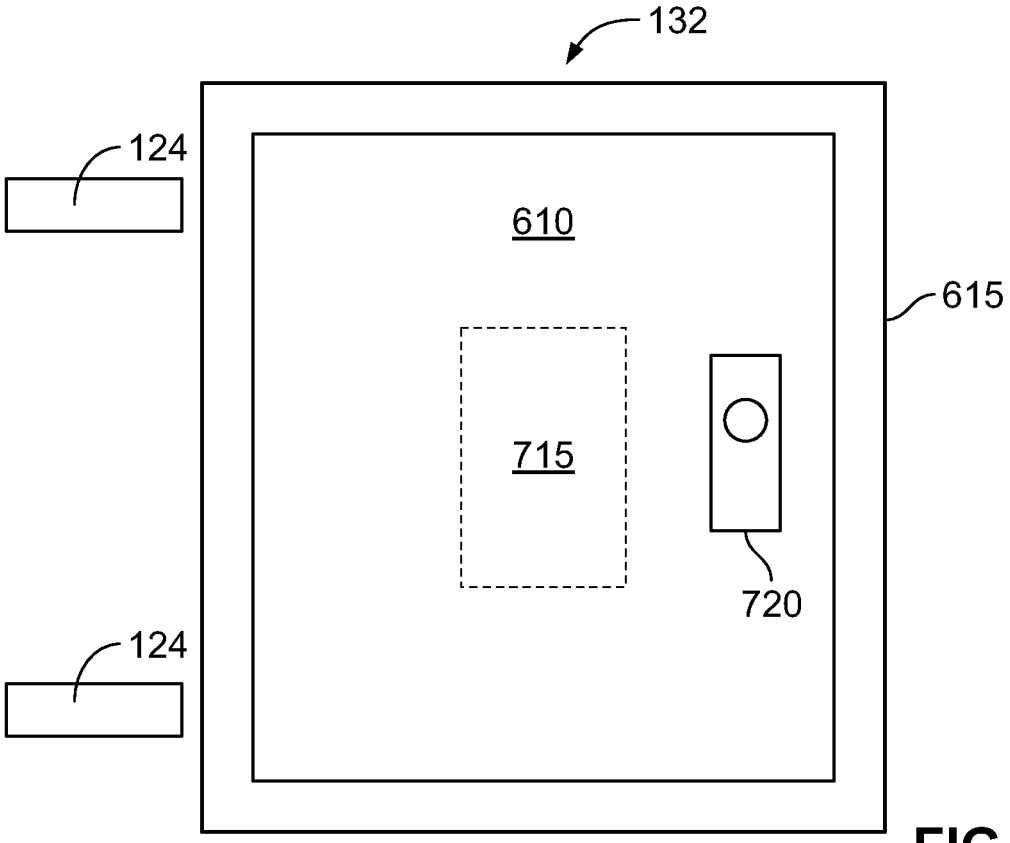
FIG. 7B is a top plan view of the card removal area without the deck of cards, showing the card support platform, card presence sensor and the load cell.

FIG. 7B is a top plan view of the scale where a small clearance is provided around the peripheral edge of the weighing platform 610 to permit the platform 610 to move freely in a vertical direction with respect to the surroundings, so that the weight is supported only by the load cell 715. The detailed construction of the scale is not shown, but a person of skill in the art would appreciate that the fit and finish of the region would be intended to ensure that cards of the deck of cards 15 would not snag on an edge of the weighing platform 610 when the cards are being moved to that location by the lift gate 124. An optical proximity detector 720 may be provided, viewing through an aperture in the weighing platform 610 as part of a sensor suite used to control the operation of the shuffler 100. Other optical and mechanical sensors that are not shown may be used to sense the location of the cards and the position of moveable portions of the shuffler apparatus 100 so as to ensure proper operation and sequencing of the steps of operation.

The card weighing platform 610 may be mounted to a weight determination device 715, which may be a load cell or the like. An example of a suitable load cell may be a GML632 Jewelry Miniature Load Cell, available from Xi'an Gavin Electronic Technology Co., Ltd., Xi'an, Shaanxi, Peoples Republic of China. Typical specifications of such a load cell are provided in Table 1.

TABLE 1

Representative Specifications of a Typical Load Cell (F.S. = 750 g)

| | |
|---|---|
| Rated load | 100-750 g |
| Comprehensive error | 0.05% F.S. |
| Rated output | 0.7 ± 0.15 mV/V |
| Linearity error | ±0.05% F.S. |
| Hysteresis error | ±0.05% F.S. |
| Repeatability error | ±0.05% F.S. |
| Creep | ±0.05% F.S./5 min |
| Zero balance | ±0.1 mV/V |
| Input resistance | 1130 ± 10 Ω or 1090 ± 10 Ω |
| Output resistance | 1000 ± 10 Ω |
| Operating temp range | −10~+40° C. |
| Temperature effect on zero | 0.1% F.S./10° C. |
| Temperature effect on output | 0.05~0.1%/10° C. |
| Insulation resistance | ≥2000 MΩ |
| Excitation voltage | 5~10 VDC |
| Ultimate overload | 150% F.S |

Load cell devices are small and lightweight and may be procured with analog or digital outputs so as to be compatible with specific system design requirements. Since the purpose of the load cell, in combination with any signal conditioning circuitry, analog-to-digital converter, processing of the digitized load-cell data and similar functions is to use the force applied to the load cell to determine the weight of an object in standardized units such as pounds or grams, in arbitrary units, or in normalized units, the ensemble of components and the processing of data is collectively termed a "scale."

Figure 8:
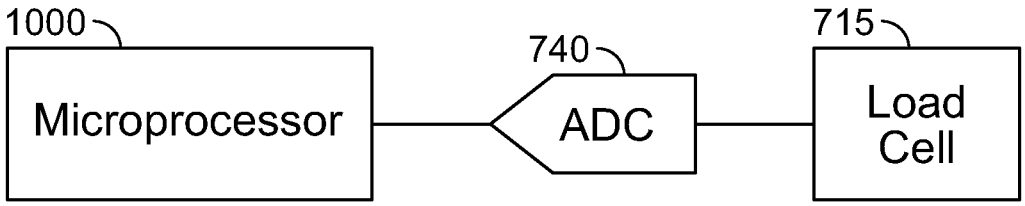
FIG. 8 is a functional electronic block diagram showing the output of the load cell being converted to a digital value and input to a microprocessor.

FIG. 8 is a simplified schematic diagram of the load cell 715, connected to an analog-to-digital converter 750 so as to provide a digital value of the analog voltage output of the load cell 715 to a microprocessor 1000. The microprocessor may be a separate device or part of the function of the system controller, as later described.

The weight when expressed in standardized units is stated in grams (1000 g=1 kg.). A scale may calibrated with a test mass having a known value of weight at a standard height above the geoid. For practical purposes, the effect of altitude on the performance of the system an method described herein is not a consideration. As part of the operational process described herein the weight value indicated by the scale without an object on the weighing platform 610 may be determined and termed the "tare" weight. The tare weight is subtracted from the weight value obtained when an object is placed on the weighing platform 610 to obtain the net weight of the object itself.

In the description of processes herein the weight values may be expressed in arbitrary units where, where the nominal net weight of a deck of playing cards is represented by a value, which may be 1000 as an example and the weight of a single card of a deck of cards having N cards is 1000/N. Where the net weight is not stated in grams, the net weight is in arbitrary units. So long as the same units (including arbitrary units having a stable value) are used consistently, a person of skill in the art would appreciate that the verification process described herein will be properly performed.

As employed herein, the system and method described uses a calibration value measured by the scale for each separate, identified deck of cards, or a single average card of the deck of cards as the criterion for verification measurements. Actual calibrated weights are not needed in normal operation, but may be used during maintenance procedures.

Figure 9:
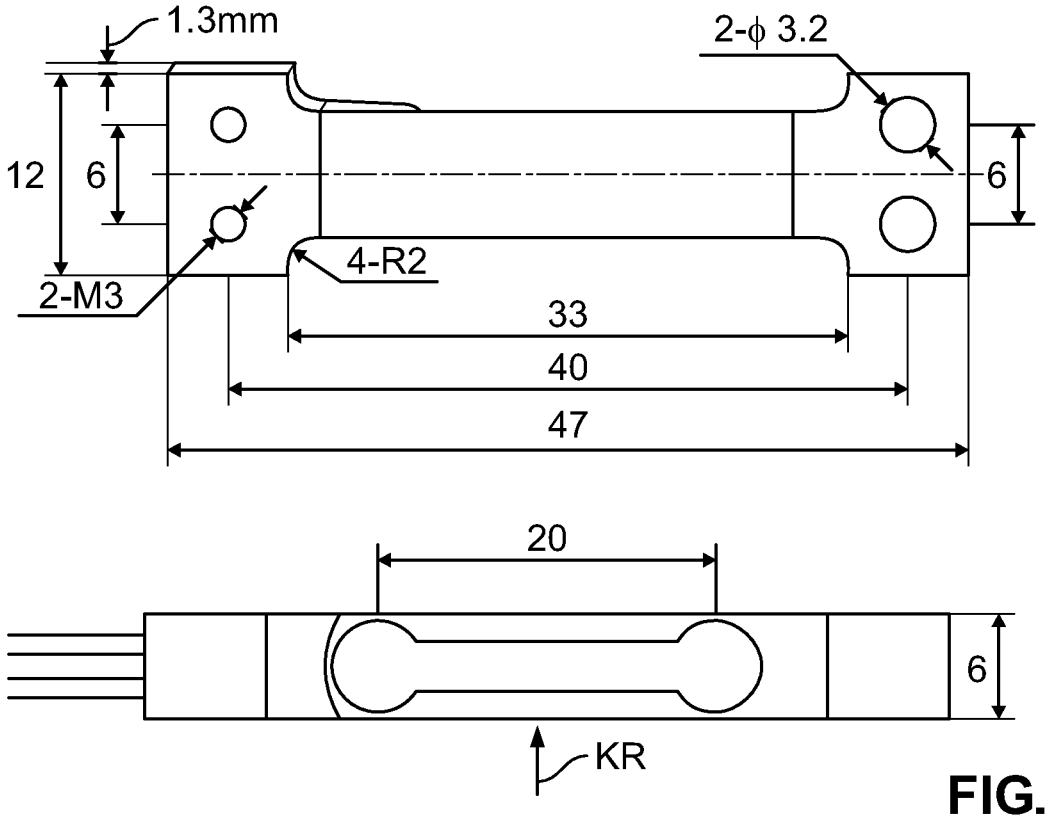
FIG. 9 is an engineering drawing showing the outline dimensions of a load cell.

FIG. 9 is a typical outline drawing of such a load cell. (Note: the dimensions are shown in mm). Load cells are available using a number of different technologies and are often based on the change of resistance or capacitance in a balanced bridge, such as a Wheatstone bridge. From a functional viewpoint, the load cell provides a voltage that is linearly proportional to the force applied by a mass to a particular portion of the load cell component. The specifications of the load cell selected, when compared with the stability and accuracy of the measurement to be made, influence the design of the remainder of the sensing apparatus and the interpretation of the measurement result. Herein, we consider that the load cell provides a sufficiently repeatable measurement of a voltage value representing the weight applied thereto and may be adapted to compensate for apparent changes in measured weight due to temperature change, ageing, or the like. The tare weight (tare value) may be measured during initialization of the shuffler and subsequently when there are no cards in the card dispensing area. A running average, exponential average, median value or the like may be used as a representative tare weight. Alternatively a short sequence of measurements may be used to estimate the tare weight before each use in the verification process. Situations can occur when a shuffled deck of cards remains in shuffler for an extended period of time, precluding measurement of the tare weight variation with temperature change, or the like. Where a predetermined time has passed during which the measurement of tare weight has not been possible, the tare weight may be re-determined by measuring the tare weight after the deck of cards has been removed from the dispensing area 132 and prior to the next shuffling cycle. Alternatively, the system may be reinitialized. Removal of the deck of cards may be sensed by a change of weight equal to approximately the weight of a deck of cards, or by an optical proximity sensor. Where a cut card is being employed, the measurement of tare weight could be made prior to placing the cut card in the card dispensing area 132. The placement of the cut card would be sensed by an optical sensor and the weight may be measured by the scale, for example, and may be used as a component of a modified tare weight.

A person of skill in the art would expect that various validity checks would be made on the performance of the measurements of weight, included expected values and extreme bounds so as to identify fault conditions.

For simplicity, where quantitative values are stated herein, the overall accuracy of the weight determination by the scale is presumed to be an overall accuracy of 0.05% of full scale (F.S.) for a full scale value of 0.5 kg (500 g), when measured at a fixed temperature. The response is sensitive to temperature changes and a typical inexpensive load cell may have a sensitivity of about 0.1% of F.S. per 10 degree C. temperature change. Slow changes in the tare weight output may be expected over a period of time. The indicated weight of the deck can be corrected for slow changes in zero reading by performing tare weight measurements when the deck has been removed from the dispensing area, use of a calibrated temperature sensor, or the like.

These performance specifications are useful for exemplary purposes, however a wide variety of specifications are available, as commercial products and the specifications discussed herein are not meant to be a limitation on the functional performance that may be achieved.

A card presence sensor 720 may be mounted to the support platform 615 beneath an aperture in the weighing platform 610 and disposed so that the lowermost card of the deck of cards 15 or a cut card is sensed when such cards are deposited on the weighting platform. The presence of a cut card or a cut card and a deck of cards may be deduced from the considerable difference in weight between the cut card alone and the combination of the cut card and the deck of cards. The sensor 720 may be an optical proximity detector such as an EE-SPY401 or EE-SPY402 available from Omron Automation and Safety, Hoffman Estates, Ill., or an OBP732 available from Optek Technology, Inc., Carrollton, Tex., as examples. The sensor may be self-calibrating for ambient light background in the spectral range used for sensing and have a digital output which may be processed to determine when an object of sufficient reflectance is within a pre-specified distance range. Herein, the sensor may be used to determine that an opaque object is approximately in contact with the surface of the weighing platform 610.

Electronically, the scale function 1300 of the apparatus may be implemented as shown in FIG. 8, where a microprocessor 1000 such as a iMU6UL from NXP (formerly Freescale) Semiconductor, Austin, Tex., which may be a component of a single-board computer available from a plurality of commercial sources, and have on-board or external flash and RAM memory. Other functions such as evaluating switch or button inputs, controlling motors or other actuators, and performing technical and logical operations associated with the shuffler apparatus may be performed by this microprocessor or by one or more additional microprocessors, processors, programmable controllers or the like. The identification of a particular microprocessor is exemplary and a person of skill in the art may choose one or more electronic components suitable for performing the functions described.

An analog-to-digital (ADC) converter that is integrated with the microprocessor may not have sufficient resolution or stability for the present use and a 24-bit ADC such as NAU7802 from Nuvoton Technology Corp. America, San Jose, Calif., may be selected as a source of digitized voltage and connected between the output of the load cell 715 and the microprocessor 1000.

A plurality of ADC samples obtained over a short period of time (such as one second, in a non-limiting example) may be arithmetically averaged to provide a more stable measurement estimate, and the overall response of the measurement function may be calibrated as described herein, including any adjustment due to change of operating temperature or ageing of the components. Alternatively, for example, the plurality of ADC measurements may be processed to obtain a median value weight estimate.

Figure 10:
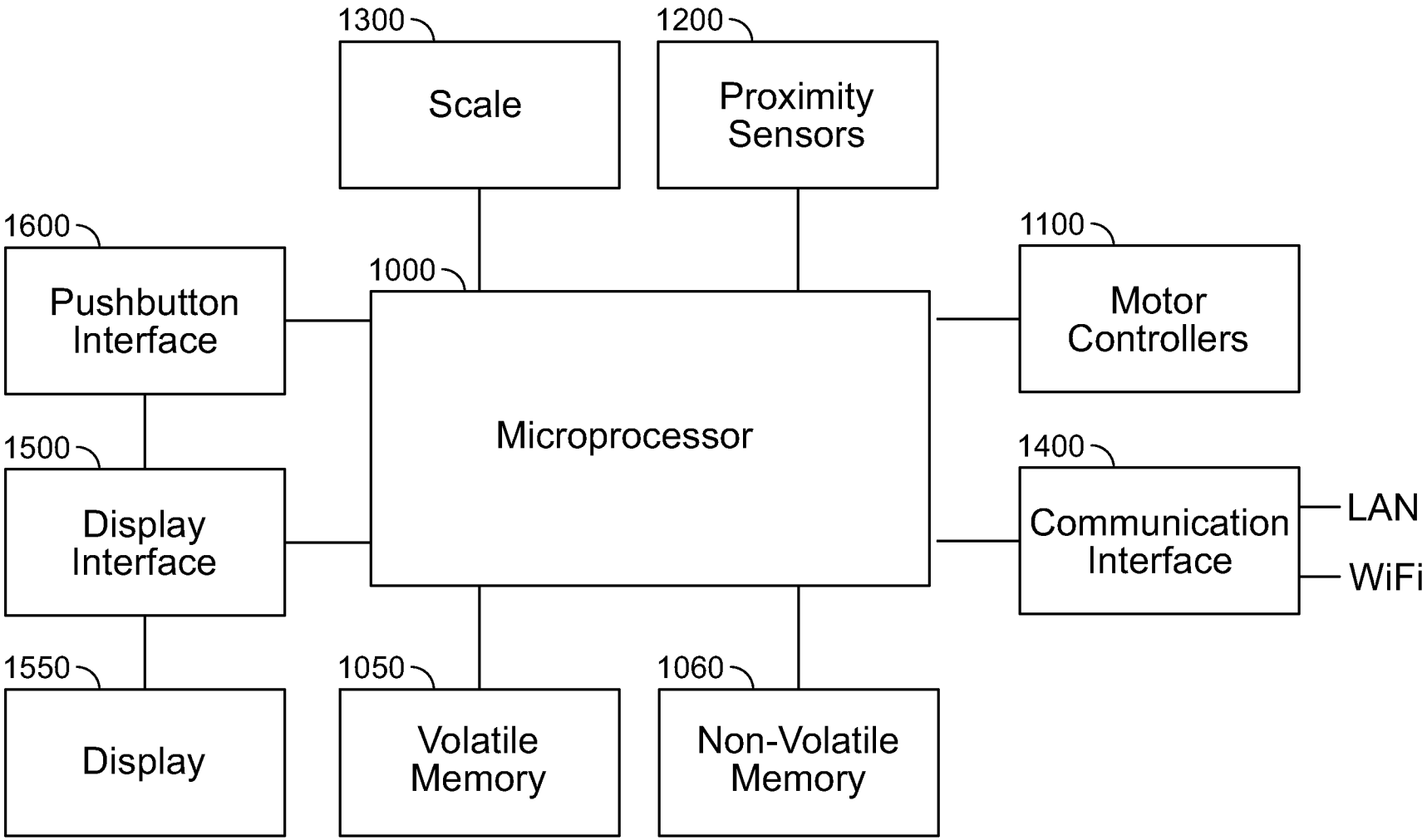
FIG. 10 is an engineering drawing showing the relationship of major electronic components of an example card shuffler.

FIG. 10 is a non-limiting representational block diagram of the electronic aspects of the electromechanical shuffler. The sensors, microprocessors, motor interfaces and the like are representative of those that may be used and not every component is shown. As is conventional, aspects of apparatus the such as the power supply subsystem which may, for example, convert conventional AC current to conditioned DC voltages for use in the shuffler. Further, the communication between the various sensors, the actuators such as motors, or the like, displays, keyboard or other control mechanisms and the like and the one or more microprocessors may be by incorporation in the microprocessor, by wired connections or by wireless connections, as is known in the art or may be developed in the future to perform equivalent functions. Some of the sensors or control devices may be integrated with the associated actuator or motor or act independently, such as limit switches or proximity sensors. However, the sensors or control devices may act through the microprocessor, processor or the like, to provide an alternate or backup functional path.

The electronic subsystem may comprise the microprocessor 1000, and a volatile memory 1050, which may be dynamic random access memory (DRAM) used as additional memory to that which may be integral to the microprocessor 1000 and be used for temporary storage of programs, data, state variables and the like, and non-volatile memory 1060, which may be flash memory of either the NAND or NOR type or other non-volatile memory type such as a hard disk drive that exists or may be developed in the future for similar purpose, and be used for non-volatile storage of operating programs, communications programs, and any data which is maintained through a period where a device is powered down or loses power unexpectedly. The programming, and data storage and date retention provisions may be governed by regulatory provisions in addition to standard design practice. As the evolution of electronics of the type being used herein may lead to new products and techniques to perform the functions described herein a person of skill in the art will realize that the description of the operation of the electronic subsystem is intended to be illustrative of the concepts disclosed herein and not to be taken as limiting the scope of devices employing the concepts.

A communications interface 1400 may be provided for computer program loading, for reporting of performance and faults, or the like, over local communications networks such as a LAN using TCP/IP protocols, over WiFi, which may further connect to local networks, or cellular telephone network, or to a remote control center over the Internet or by other wired connection.

Operator interface by the user of the shuffler may be through push buttons or switches 1600, shown as buttons 410 and 420 in FIG. 2B, an alphanumeric keyboard, or a virtual equivalent thereof, or a display interface, which may be integral to the shuffler or connected through a communications interface so as to be positioned in an ergonomically suitable location. The display function 1550, shown as 750 in FIG. 3, may be any known visual display type known in the computer arts, such as an LCD, OLED, plasma display, cathode ray tube (CRT), or the like. The display may have capability for alphanumeric display, graphical or image display, or have color capability depending on the specific design used. Further, the display 1550 may have a touch-screen capability so the operator may interact with the shuffler using soft-key icons in place of or in addition to the button and switch interfaces, if any. If needed, a plurality of button or switch interface components or circuits may be provided, including the ability or control switch lighting and auxiliary sounds. Visual cues and audible sounds, which may include synthesized speech for announcements such as a failure to verify a deck, or to supplement or replace visual cues provided by a display or lighting as part of the routine operation or set up of the shuffler.

A microphone (not shown) may be provided for accepting audio input, which may be processed by the shuffler using voice recognition technology, as is known or may be developed in the future, either within the shuffler 100 or by communication over the communications interface 1400 so as to respond to audio cues or to provide for operational commands to be executed by the shuffler 100 or by a remote control center. A corresponding audio output may be provided to supplement the display function.

At least one scale 1300 may, for example, comprise, a load cell 715, a weighing platform 610 and an electronic interface, which may include ADC 780, is provided to verify the integrity of each deck of cards 15 after shuffling and prior to use of the cards to play of a game of cards. One or more optical sensors 1200 (e.g., optical proximity sensor 720) may be used to confirm or to detect the presence of cards in different locations about the shuffler and, in accordance with the operational program logic and state, to control the electromechanical aspects of the shuffler through the motor controllers 1100 to perform the various actions needed to accept the cards, shuffle the cards, verify the cards and to dispense the cards after verification.

In an aspect, the operation of the shuffler may employ sensor inputs such as the optical proximity sensor 720 or the scale 1300 or the like to initiate or regulate the sequence of operations of the shuffler in normal operation and during an initialization phase. (Where the weighing platform 610 is used in conjunction with the load cell 715 and other features of the shuffler, the weighing platform 610 may be used as a proxy for the overall scale function 1300.)

Ancillary equipment such as a power supply, which may be batteries, a AC-DC converter (battery eliminator), an AC power supply, a controller, or the like, are not shown as they are well known to persons of ordinary skill in the art, as are the various types of motors, displays, solenoids, control interfaces and the like.

In a circumstance where a deck of cards 15 is present in the input area 130 and another deck of cards 15 is removed or has recently been removed from the dispensing area 132, the shuffling operation may, for example, commence automatically after passage of a predetermined time interval, commencing with a step of automatically closing the access door 104 and introducing the deck of cards to be shuffled into the shuffling compartment 128 through the trap door 111. Alternatively, the shuffling operation may be initiated by pushing or touching a button, such as 410, touching an area on a touch screen, manually closing the access door 104, or by voice command, depending on the design and configuration of the specific shuffler design. In another aspect, the shuffler may be configurable to determine that a deck of cards has not been placed in the receiving area within a predetermined period of time and to require the operator to perform a manual operation, such as pushing a touch button, to initiate an alternative shuffling mode or a recalibration of the shuffler.

The specific sequence of operations to be performed by a shuffler, the response to error conditions, or the like, may differ due to detailed design considerations or regulatory requirements without limiting the scope of the card deck verification concept.

In an aspect, verification of the integrity of a shuffled deck of cards 15 may be performed by accurately measuring the weight (or a measured value resulting from the weight of the deck of cards on the scale platform 610) of the shuffled deck of cards 15 and comparing the weight determined by the scale 1300 with predetermined upper and lower weight limit values prior to permitting access to the deck of cards 15 for removal from the apparatus 100 for use.

In an aspect, a predetermined verification (weight) value may be that of a deck of cards determined in a calibration step and the upper and lower bounds on acceptable variation during normal operation as determined during the design process. The use of the term "weight" is not intended to limit the units in which the predetermined verification value is expressed. Rather the verification value is expressed in whatever units of measure or arbitrary units that are used in the particular design. Similarly, the a predetermined card verification value may be a similar concept where the verification value for a card is the verification value for the deck of cards divided by the number of cards in a verified deck of cards (e.g., 52). Where the weight is determined by a sequence of weight measurements by the scale, the estimate of the weight may be selected from an arithmetic average of the measurements, the median of the measurements, or the like where preferably the same method of estimation is used for each weight determination that is used in a comparative sense. So long as the accuracy of the weight measurements being compared is consistent with the objective of verifying that the number of cards in the deck of cards being processed has not changed from the calibration value, the estimating algorithms would be satisfactorily performed.

When using the weight of a card or the weight of the deck of cards as verification technique, the variation of the weight of decks of cards of different manufacture, face size, thickness and material needs to be considered. Since the weight of a single card of the deck of cards 15 will vary depending on the specific card product used, entry of a specific weight of a card of the deck of cards, or of the deck of cards to represent playing cards of various origins and styles as a criterion for determining the integrity of the deck of cards may be too imprecise, subject to error in data entry and may be inconvenient from a configuration management viewpoint. Further, some types of playing card material, such as plastic-coated paper, are known to absorb moisture and may weigh different amounts depending on the storage conditions prior to un-packaging for use and during the initial stages of use.

An object of the verification process using weight is to adapt the verification decision criteria to actual decks of cards being used, including any temporal change in weight during use, or the variation of the measured weight due to temperature changes of the weighing apparatus or longer term drifts of scale factor or zero weight point.

Prior to beginning to use a deck of cards in a table game of cards, the supplied deck of cards may be removed from the factory package and displayed, face up, on the game table so that the individual cards of the deck of cards may be observed by the players and the dealer. The initial state of the cards is in a known order of values and suits in a factory-packaged deck of cards permitting rapid visual inspection and verification. Cards which are not used in the selected game of cards, such as jokers, may be removed from the deck and discarded to create a deck of cards 15 to be used. In the case of conventional poker or bridge games, the number of cards is 52, comprising 13 cards in each of four suits. A deck of cards 15 that has undergone the visual inspection process, which may include other steps such as actually counting the cards, may be termed a "visually verified" or "manually verified" deck of cards.

In an example, the use of the shuffler 100 to verify the integrity of a deck of cards 15 during the playing of successive games of cards is described. The description is not meant to detail every aspect of the process, nor is the present description represented as being fully compliant with the regulations of any competent authority having the responsibility to certify the process described for use, for example, in a casino. Rather, the concept and examples of construction and a method of use that would result in a product adapted to meet such regulatory and customer requirements without undue design effort or experimentation are described, as would be appreciated by a person of skill in the art.

After a shuffling step to randomize the order of the cards of the deck of cards and prior to the use of the deck of cards in the play of a game of cards the deck of cards may be verified. By preforming the verification of the deck at this stage of the game of cards, a player is assured that the game of cards has been initiated with the proper number of cards in the deck, and that the cards of the verified deck of cards are unchanged throughout play of successive games of cards.

Changes in the number of cards of the deck of cards that occur between the start of dealing the cards for the game of cards and the completion of the next shuffling process for that deck of cards will be detected. Cards may have been be removed from, or added to, the deck of cards between the start of the deal and act of collecting the deck of cards that have been used so as to re-introduce the cards to the shuffler. Cards may be lost due to mechanical errors within the shuffler which may arise from wear to the cards over the course of a series of games, or damage to the cards due to nicking, bending, folding or warping. All of these alterations in the number of cards of the deck of cards are undesirable. If the deck of cards is verified at the time of introduction to the shuffler, then loss of cards in the shuffler will not be determined until the next game of cards has been played and the now-unshuffled are cards reintroduced to the shuffler. Where multiple decks of cards are alternately used to play the game so as to speed up play, the error may not be discovered until a subsequent of cards has begun. Discovery of such an event after the wagers on the game of cards have been settled may be problematical.

The shuffler apparatus may be initialized for verification purposes by inserting the visually verified deck of cards in a receiving area of the shuffler where a deck of unshuffled or previously used cards would be expected to be placed so as to be randomized by the shuffler. A shuffling process is initiated and upon completion of the shuffling process, the cards are weighed in the dispensing area. The first time that such a deck of cards is shuffled, the weight of the deck of cards, which may be a verified deck of cards, may be determined by the scale and the weight is stored as a verification value for comparison with later measurements. When two decks of cards are used alternately in playing successive games of cards, the second deck is initially processed in the same manner as the first deck of cards to determine the verification value (weight) of the verified second deck of cards. The weights of the decks may be used individually for the verifying the corresponding deck of cards. The initialization process is further described elsewhere.

The inventor has determined by experimentation that the verification weight value of each deck of cards should be determined and maintained separately, and the appropriate verification weight value used to verify the corresponding deck of cards. Averaging of the verification weight values of two different decks of cards for use as a composite verification weight value may not yield a low enough rejection rate to be compatible with the efficient operation of the shuffler apparatus in expediting the play of hands of cards.

During the initialization process, the net weight of each deck of cards is determined using the scale, and the value of the weight $W_{1,2}$ stored in the memory of the shuffler, typically along with other data, for example, a date-time stamp. For descriptive purposes, the weight of the deck of cards being processed is represented by W. For use in this example, the approximate weight of the deck of cards may be 104 g, so that a card of a 52 card deck of cards weighs 2 g.

Thus, the expected value of the weight of a deck of cards containing 52 cards would be 104 g. If a card was added to the deck, the resultant weight would be 106 g; alternatively, if a card were to be removed from the deck, the resultant weight would be 102 g. Notwithstanding the known error mechanisms in measuring the weight, the actual weight of the deck of cards is expected to change only by discrete increments of the substantially the weight of a card from deal-to-deal of the same deck of cards: in this case, 2 g from the 52-card value, as changes in the number of cards in a deck of cards occur in discrete increments.

Consequently, the repeatability of the weighing of the decks of cards during the playing of the game needs to be consistent in accuracy and repeatability with the expected change in weight for a deck that will be rejected during the verification process as having more or less than 52 cards. In a non-limiting example, an upper bound on the acceptable weight may be 104.75 g and a lower bound may be 103.25 g, if the number of cards of deck of cards had not actually changed during the course of play or shuffling. Since a similar overall measuring error (e.g., ±0.75 g) would obtain for a deck of cards having one card greater or one card less in the deck, one would expect that maximum values of 102.75 would be obtained for a 51-card deck and minimum values of 105.25 g would be obtained for a 53-card deck. Measurement that fall between the limits for the discrete number of cards could result in a warning. Measurements that are outside the limits for the cases of a single card error may be also considered to be a failure to verify the deck of cards. Other limits and decision strategies are possible and the above is merely exemplary. In another example the magnitude of overall measuring error may be about half the weight of a card of the deck of cards being used.

In an aspect, the measurement limits may be set as fixed limits as used above, as a percentage of the weight of a card (for example, +/−20% of the weight of a single card of the type of deck used for calibration purposes), or a statistical limits based on the distribution of weights measured by the verification procedure during the play of games of cards subsequent to initialization, for example.

In another aspect, the tare weight may be expected to change with time as there is both set point drift and temperature drift in the output of a load cell or any similar apparatus. Some scales are self-compensating as they set a value based on sensing a known lower limit on the object to be weighted (for example the weight of the weighing platform 610), and where such a scale is used, the weight need not be compensated for the tare weight. Alternatively the gross weight of the deck of cards, including the tare weight may be used as the verification value providing that the weight of the weighing platform is considered when setting tolerance limits and computing the verification value of a single card if such is needed.

Here, we describe several methods of determining the tare weight (value) reading of the scale. In a first example, the shuffler 100 shuffles the deck of cards inserted in the receiving area 130 by introducing the deck of cards into the shuffling compartment 128, and once the shuffling process has resulted in a randomized deck of cards, but before moving the deck of cards to the dispensing area 132, the load cell 610 can be activated to measure weight (tare value). The scale may also be activated prior to the shuffling process when there are no cards in the dispensing compartment 132. Since no cards are expected to be on the weighing platform 610, the measured weight is the tare weight. This may be confirmed, in some examples, by the use of an optical proximity sensor 720. However, a further check that some object is not on the weighing platform may be performed by comparing the measured tare weight with the previously measured tare weight or with a running average over a plurality of shuffling operations or with some other time or temperature dependent value. The weight of the weighing platform may also be determined by design calculations or during manufacturing testing.

As the zero-point value of the load cell is a function of temperature, one may expect that the measured value of the tare weight will change during the initial warm up process when the shuffler is turned on or the ambient temperature varies with the occupancy of the room or other factors. Typically, once the shuffler has reached a steady-state temperature, the changes with may be slower, but the internal temperature of the shuffler may change depending on the duty cycle of the shuffler. Various methods may be used to accommodate the effects of temperature on the tare weight and scale factor, such as using the latest measured value, maintaining a running average of the measurements over a predetermined number of the most recent measurements, an exponential arithmetic average, or a measurement corrected using a temperature sensor and a predetermined temperature coefficient. Any such method that can identify anomalous readings and result in a satisfactory estimate of the tare weight consistent with the overall performance requirements may be used. Note that the tare weights determined for successive shuffling cycles may be consolidated and a single value used for computation, since the tare weight is independent of the weight of the deck of cards.

The linearity of the output voltage level of the load cell for a fixed weight may also be temperature dependent and there may be a secular creep in the zero-point value. Either the specifications may be determined such that the effects do not affect the reliability of the verification process or, for example, the time-series average over recent shuffles of measured weights can be processed to determine the nominal weight W used as a verification weight value for each deck individually.

In an example of use, the dealer may operate the shuffler having a verification function in accordance with a predetermined sequence of steps to verify the integrity of each shuffled deck of cards prior to use in a game of cards.

Figure 11:
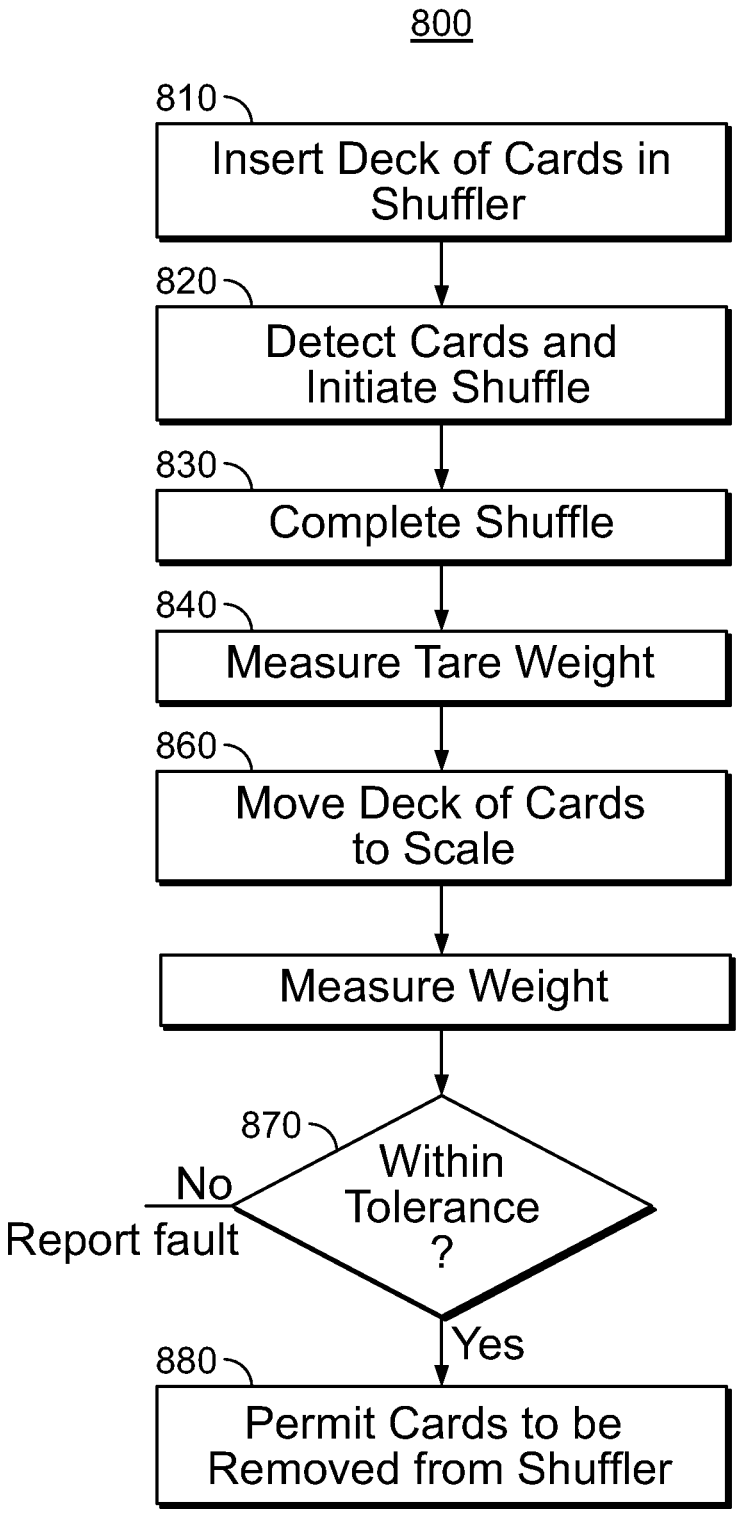
FIG. 11 is a simplified example of the process for verifying a deck of cards after the cards have been shuffled.

In normal operation, after initial calibration of the shuffler which will be described subsequently, the verification the integrity of a deck of cards by the shuffler 100 may performed during the shuffling process as described in FIG. 11. The deck of cards 15 to be shuffled is inserted into the shuffler (step 810) at a location 130 that accepts cards that are to undergo the shuffling process. Access to the card receiving area 130 may be optionally regulated by a lid or door 104 that may open either automatically or in response to an operator input, for example, through one or more of the control buttons. When cards are introduced into the shuffler at the card receiving area 130, the presence of cards at the input location 130 may optionally be determined using an optical proximity sensor, or the user may push a button 410 to initiate the shuffling process. In an aspect, the shuffling process may not to proceed until the dispensing location 132 is void of a deck of cards. If cards remain in the dispensing location 132 the user may be alerted by at least one of a visual cue so as to take remedial action After completion of the shuffling process, depending on the specific configuration of the process, the presence of a deck of cards 15 at the dispensing area 132 may be determined using at least one of the scale 1300 or the optical presence sensor 720. The details of the shuffling process 820 may differ depending on the physical and conceptual design of the shuffler, however one may presume that, at the completion of the shuffling process, and before the cards are moved to the dispensing area 132, the cards have been sufficiently randomized to meet operational requirements. When the shuffle operation is completed 830, but prior to moving the shuffled cards to the dispensing area 132, the scale may be used to measure the tare weight 840. Alternatively, the tare weight may be determined after the unshuffled cards are received in the receiving area 130 and prior to commencing the randomization operation. The measured tare weight may be compared with the present value of target tare weight, which may be a fixed value, or determined by any suitable analysis of previously measured tare weights such as previously described. The tare weight is independent which of a plurality of decks of cards is currently being validated, so the target tare weight can be updated each time a deck of cards is shuffled.

The measurement of tare weight is only performed when the dispensing location 132 is void of cards, and the shuffled deck of cards may then be moved 850 to the dispensing location 132 so as to be positioned on the scale platform 610. The optical presence sensor 720 may be used to verify the presence of a deck of cards 15 on the scale platform 610 and the scale assembly used to determine the gross weight 860 of the deck of cards 15. The tare weight is subtracted from the gross weight to yield the net weight of the deck of cards

15. Alternatively, the gross weight may be used for both the measured weight of the deck and for the verification weight.

In an example, to simplify the discussion, the verification process is described for a single deck. Where two decks of cards are used in the play of a plurality of successive games, the additional steps are essentially repetitive for the second deck and are described subsequently and the decks of cards are used alternately.

The measured weight Wm is compared 870 with the expected or target weight Wt (a verification weight value) and the magnitude of the difference between the two values is compared with the established tolerance, T. If the difference is less that the tolerance, the deck of cards is considered as verified, where the term "verified" means that the correct number of cards, in this case 52, is present. If the variance is greater than the tolerance, either a warning is provided if the variance is less that a confident determination that one or more cards have been added or removed from the deck, or a fault is indicated when the variance is consistent with either the addition or deletion of a card, or multiple cards. The alerts may be auditory or visual. Where access to the dispensing location 132 is controlled by a door 104 or other means, the door 104 may be opened 880 only when the cards have been verified or for maintenance. Typically, the operator may initiate the opening of the access door by pressing a button; however the door may be opened automatically in some examples. Where a fault or warning is declared, the operator may be required to press one of the buttons 410, 420 in order to cause the door to open. In an alternative, one of the buttons or the display is used to indicate the presence of a shuffled and verified deck of cards in the dispensing location and the door is opened by pushing one of the buttons.

The operator may initiate the next shuffling operation by a sequence of steps that are consistent with the configuration of the shuffler apparatus. In an example, once the door 104 has been opened at the conclusion of the shuffling and verification process, an unshuffled deck of cards may be placed in the receiving location 130; and, the shuffled deck 15 may be removed from the dispensing location 132 for use. When this occurs, the optical presence sensor 720 may detect the absence of cards. Optionally, the scale may detect that change in measured weight is consistent with the change in weight when a deck of cards is removed. At this juncture a new shuffling sequence may be initiated, which may include starting the process at step 820, including the optional closing of an access door 104.

A particular sequence of inserting and removing decks of cards may be prescribed so as to establish a ritual pattern of operation or to meet regulatory requirements. For example, at least a deck of cards may be required in one of the receiving location or the dispensing location at all times, except for a predetermined short period of time. Removal of both decks of cards from the shuffler apparatus for more than the predetermined short period of time, perhaps 6 seconds, may be detected and require that the shuffler be reinitialized by a process that is now described. A re-initialization may also be required after a power loss or a predetermined period time of routine operation.

Figure 12:
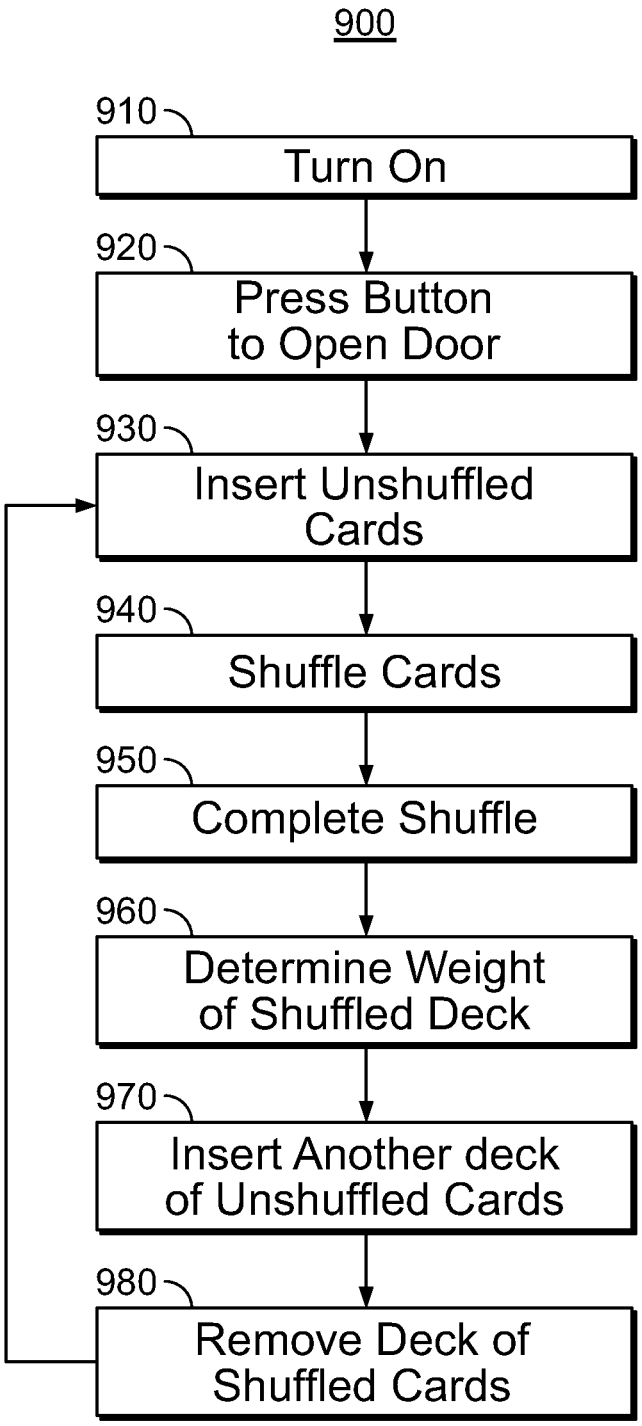
FIG. 12 is a simplified example of a method of processing two decks of cards in sequence so that one of the decks of cards can be used to play a game of cards while the other deck of cards is being shuffled and verified.

Initialization 900 or re-initialization of the shuffler apparatus as shown in FIG. 12 is substantially the same process, except that in the case of re-initialization, the shuffler power may be on and the re-initialization process may need to be initiated by a specific operator action, such as pressing buttons 410 and 420 simultaneously. The operator will have prepared at least one verified deck of cards, as previously described.

Where the initialization process 900 is being performed after initial turn-on step 410 of the shuffler, the status may be indicated to the operator using a display function or by a known state of the control buttons. In an example, both buttons 410 and 420 (button 1 may be green and button 2 may be red, for example) may be illuminated. The operator may press the green button and the shuffler may open the door 104 so that a first visually verified deck of cards may be inserted 930 into the receiving location 130. The operator may be provided with messages on the display as reminders of the operating sequence. The dispensing location 132 should be empty at this juncture, but this status may be confirmed by weight or optical sensing. The shuffler door 104 may close under program or operator control and the shuffling process may be performed 940. Prior to moving the cards of the deck of cards 15 to the dispensing location 132, the tare weight is determined as previously described. However, there may be no established tare weight and the initial value of the tare weight may be determined. The deck of cards is moved to the scale platform 610, in the dispensing location 132, and a gross weight of the deck of cards determined. The net weight may be determined by subtracting the tare weight from the gross weight. During initialization there is no reference verification weight for comparison purposes and the initially determined weight is used as the reference verification value for the first deck of cards. The programming of the shuffler may impose overall gross weight limitations, consistent with the ensemble of different card weights previously described so as to avoid configuration errors.

Optionally, the gross weight measurement may be used as the reference or verification weight and the tare weight may not be separately measured either during the calibration sequence or in normal verification operation.

When the calibration process for the first deck is completed, either the door 104 opens automatically or a button (for example the green button) is illuminated and the operator presses the button to open the door 104 to place a second visually verified deck of cards 970 in the receiving location 130 and to remove the processed first deck of cards 980 from the dispensing location 132. The door 104 may close automatically upon sensing this exchange of decks, or the operator may push a button, for example, the green button, to initiate the shuffling and verification process by closing the door 104 to perform the shuffling and verification process again on the second deck of cards. The measured weight of the second deck of cards may be maintained as a verification value of the second deck of cards.

Verification errors are considered an exception and a frequent occurrence of such errors is not anticipated in a well conducted casino operation. When such errors are encountered, the operator needs to perform a diagnosis of the source of the error. Let us assume that, inadvertently, a card was not properly collected into the deck of cards after the play of a hand of cards, and when verified by the shuffler, the verification operation failed as there were only 51 cards in the deck. The dealer would need to locate the missing card in order to proceed. If the card cannot be located, this event may indicate an attempt to defraud the casino and would need to be investigated. Similarly, if the verification process resulted in a determination that there were 53 cards, for example, then there would be an additional card in the deck. The additional card should be visually obvious as when two decks of cards are used, the back of each deck of cards are usually of different colors and possibly designs. So, in the event of an error of this type, the contents of the deck would be easily corrected and the cards would need to be reshuffled as decks of 52 cards. Remedial action may also include reinitializing the shuffler as previously described. Alternatively, the shuffler may process the next two decks as if a verification initialization process is being performed and to reset the verification weight values based on the most recent weight data. Another approach is to continue to use the previously determined verification weight data since the decks are now of the same configuration as the original decks used for initialization.

In another aspect, the apparatus and method may accommodate the use of a "cut" card 16 (not shown as it becomes the bottom card of the deck of cards). The cut card is intended to be easily differentiated from any other card in the deck of cards and to protect the bottom card of the deck of cards from being exposed to view. In an example, once a shuffled deck of cards 15 is removed from the dispensing area 132 and the presence of a deck of cards in the card receiving area 130 is sensed, and any time sequencing criteria is met, the card shuffling process can begin, either automatically or based on an operator input. Alternatively, the card dispensing area 132 is first checked to determine if a card or cards are present. If the proximity sensor 140 shows no card is present or the scale 1300 indicates that no card is present on the weighing platform 610, the shuffling process may be paused and a warning, visual or auditory may be provided to the operator to place a "cut" card into the card dispensing area 132. If the cut card 16 had been sensed initially or the operator has now introduced a cut card into the card dispensing area, the shuffling process may either start or resume. The presence of a cut card may be sensed by at least one of sensing the weight of the cut card 16 or by using the optical sensor 140 to determine that there is a card or cards in the card retrieval area. A reliable approach to making this determination is to determine the weight measured by the scale 1300 when the sensor 720 senses the presence of one or more cards. However, either the presence sensing or weight technique may be used alone.

In this example, the weight measured by the scale 1300 may be one of the tare weight (that is, the weight of the sensing platform 610), the weight of the sensing platform and the weight of the cut card 16 or the weight of the sensing platform, the weight of cut card 16 and the weight of the deck of cards 15. The tare weight may be determined during calibration or whenever the proximity sensor 140 determines that there is nothing on the weighing platform 610. The weight of the cut card 16 may be a predetermined weight that is used when the cut card shuffling configuration is used. Considering the accuracy of the weight measurements, the sensing of a weight value single cut card is practical as the weight of such a card may be similar to a single card of the deck of cards.

The details of the process of using a cut card may vary with the detailed design and configuration of the apparatus 100 and may need to be adapted to meet regulatory requirements.

Figure 13:
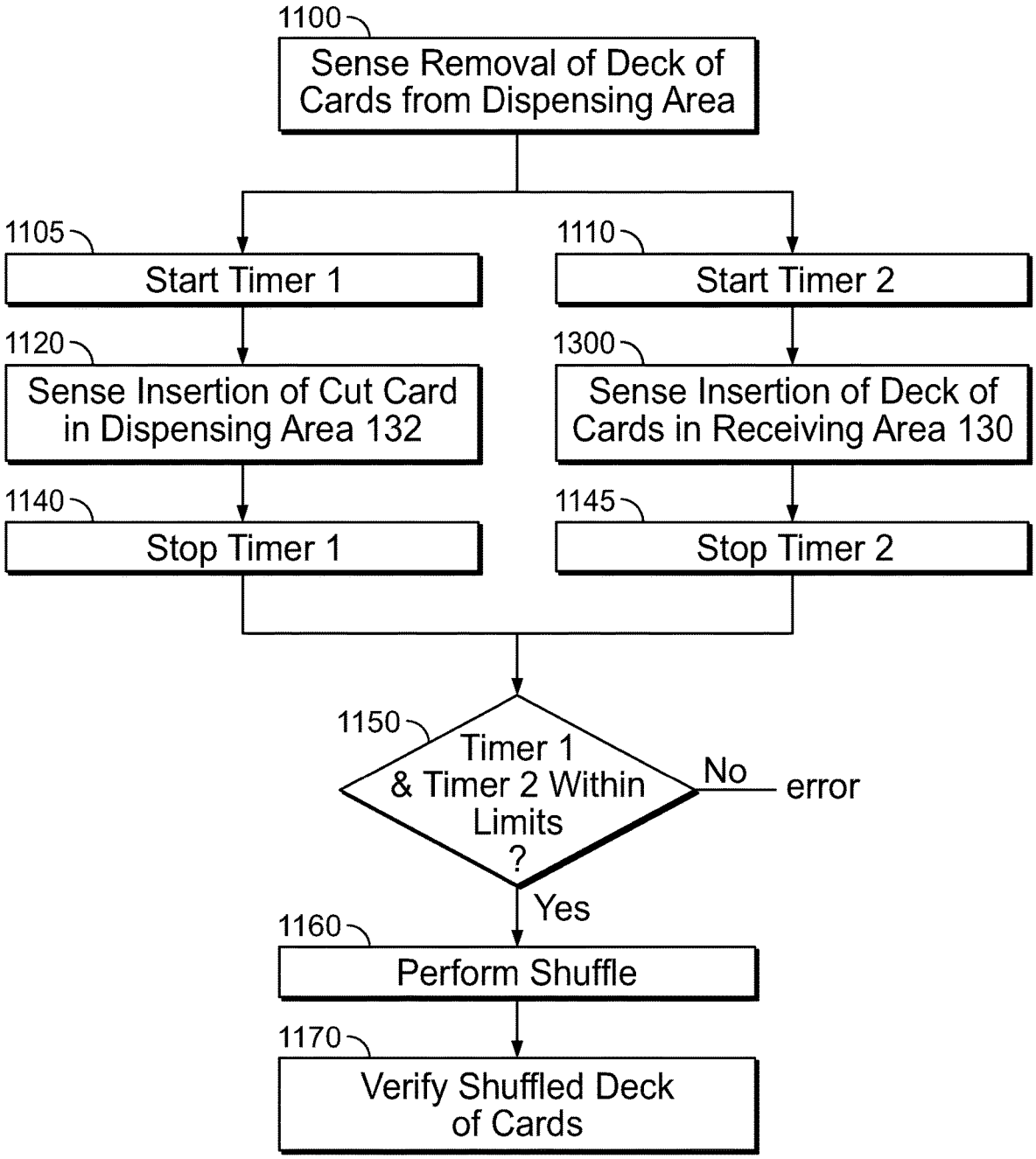
FIG. 13 is an example of a portion of a method of operating the shuffler where a requirement that the time period between the removal of a deck of cards from the card removal area and placement of a cut card in the card removal area and a deck of unshuffled cards in the card receiving area be limited so as to keep the sequence use of the decks of cards.

A non-limiting example of a method of using the shuffler apparatus 100 to verify the integrity of a deck of cards 15 that includes a cut card 16, is shown in FIG. 13, where the details of the shuffling process and verification process previously described are omitted for clarity. This method may be applied in any shuffler where the presence of the cut card 16 on the weighing platform may be sensed by at least one of a presence sensor or weight measurement.

The additional steps to enable cut-card sensing start with the removal of the shuffled deck of cards from the card dispensing area (step 1100). This act may be sensed by the reduction in measured weight from that of the full verified deck to approximately the previously known tare weight value and may also be detected by the proximity sensor indication no card or cut card 16 is in proximity to the weighing platform 610. Where the shuffler identifies any extended period of time where the deck or decks of cards are not being processed fairly often and in a proper sequence, a first timer (step 1105) and a second timer (step 1110) may be started. After removal of the deck of cards 15 from the card dispensing area 132, a cut card 16 may be placed in the card dispensing area 132. This may cause the first timer to stop. The second timer may be used to measure the elapsed time to the insertion of a deck of cards 15 in the card receiving area 130 (sensed optically or by weight) and the timer may be stopped. The sequence of operations is considered successful (step 1150) if neither of the timers exceeds a preset time limit, which may be different for each timer.

Where the process thus far has determined that a cut card 16 is in the card dispensing area 132 and a unshuffled deck of cards (this is, a deck of cards whose next state will be that of being shuffled) is present in the card receiving area 130 within the predetermined time limits, the shuffling process (step 1160) is performed, and once this is completed, the shuffled deck of cards is moved to the card dispensing area 132 for verification (step 1170). The shuffled deck is thus positioned on top of the cut card.

The weighing process is performed and the criterion for acceptance is that the net weight of the deck of cards 15 is within the tolerance limits that have been established. In this example, the net weight is the measured weight less the weight of the cut card 16 and the tare weight. As previously described, the total weight measured may be compared with a weight that includes tare weight and cut card weight.

Optionally, another check to determine that the cut card is present may be performed prior to moving the deck of cards to the card dispensing area after the shuffling operation.

The deck of cards processed during a first pass through the initialization process had been visually verified prior to processing and may be used to play a game of cards during the time that the second deck of visually verified cards is being verified by the shuffler when two decks are used in alternating games of cards.

After the initialization or re-initialization of the shuffler, and in normal operation where no verification errors are detected, two decks of cards may be used in sequence to play sequential games of cards so that the second of the two decks is in the process of being shuffled and verified during at least a portion of the time that the game of cards is being played with the already shuffled and verified first deck. This subsumes the time required for the shuffling and verification process in the time for play of the game and contributes to an accelerated pace of play.

Figure 14:
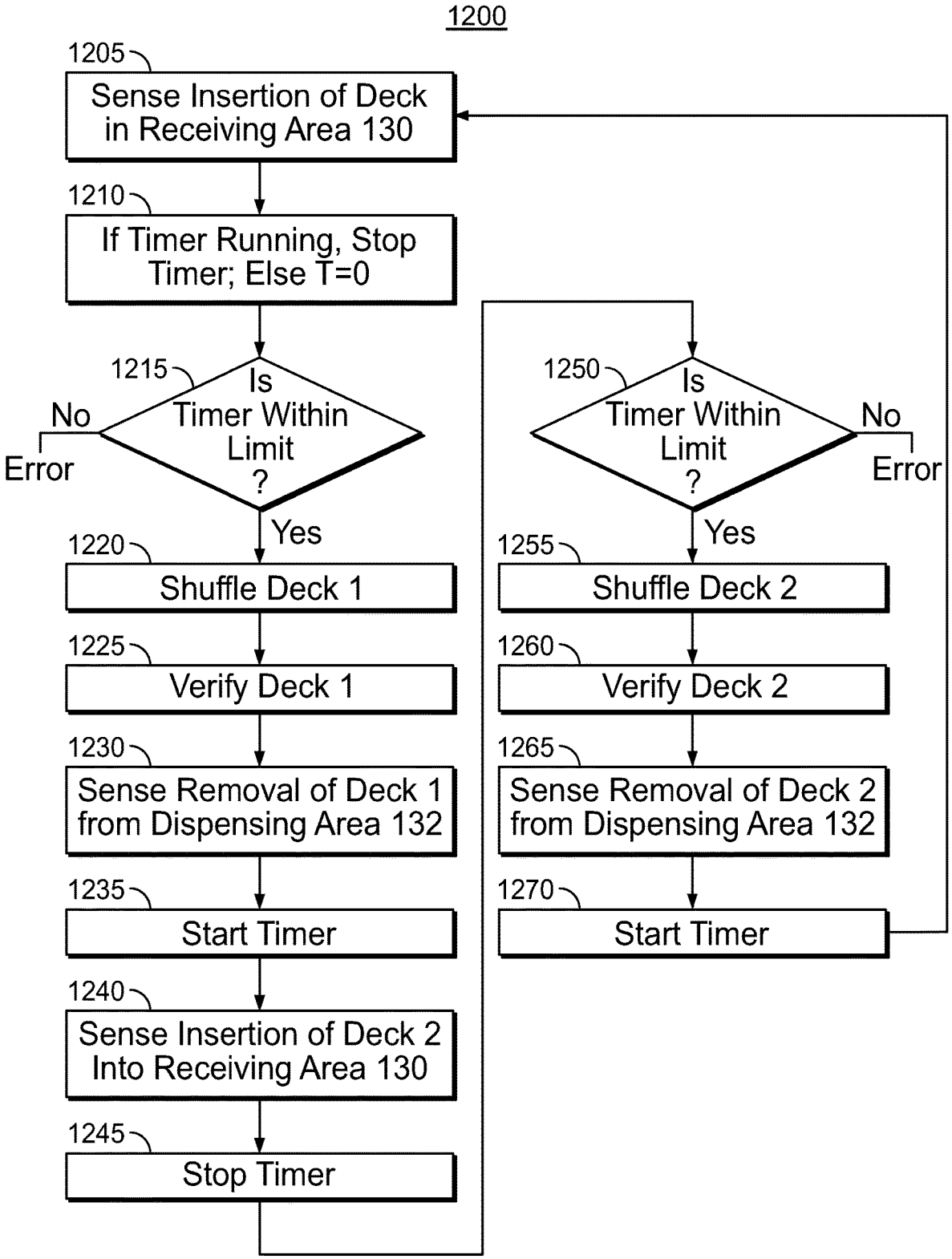
FIG. 14 is a detailed example of the method of sequencing and verifying two decks of cards.

FIG. 14 illustrates an example of method 1200 of using a two-deck alternating sequence, including initialization. After powering on the shuffler 100, the presence of a deck of cards 15 in the card receiving area is sensed, typically by an optical proximity sensor, although a scale may be optionally used (step 1205). The first time through the verification process (step 1210) will determine if the timer is running. If the timer is running, the time is stopped and the time value compared with the predetermined time limit. In normal operation this time limit is intended to determine that the unshuffled deck in card receiving area 130 has been placed in the card receiving area 130 within a predetermined time from the time that a shuffled deck has been removed from the card dispensing area 132, so that the proper sequencing of card decks occurs.

If the time limit is not exceeded (step 1215), the cards are shuffled (step 1220), as previously described, and the weight stored so as to be used to verify subsequent decks of cards. The verification process (step 1225) may be performed as previously described, however, in this instance the weight just obtained may be used as the verification weight.

Except for the performance of the verification process after completing a shuffling process for randomization and the moving of the shuffled deck to the dispensing area, process operations may be performed in any logical order, or be omitted without changing the disclosed concept. At this juncture, the shuffled first deck of cards is present in the card dispensing area 132 and the operator may be notified of the availability of the verified deck.

When the removal of the first verified deck of cards from the dispensing area 132 is sensed (step 1230) and a the timer started (step 1235) and run until the insertion of a deck of cards in the card receiving area 130 is sensed (step 1240). The time value is recorded.

Note that the process may provide for an alternative set of actions where the unshuffled deck of cards is placed in the card receiving area 130 prior to removal of the shuffled and verified deck of cards from the card dispensing area 132. In such an instance the timer may start and immediately stop, or the time may be bypassed and a zero value time value stored.

In either case, if the measured time value is compared with the predetermined time limit value and if the time is less than the limit (step 1250), the second deck of cards is shuffled (step 1255). Since the weight of the second deck of cards has not as yet been determined by actual weighing, the weight is determined as if the cards had previously been verified, but the weight is used as the verification weight value for verifying the second deck of cards (step 1260). This second weight value is stored for future use in verifying the second deck of cards. At this juncture, the shuffled second deck of cards is present in the card dispensing area 132 and the operator may be notified of the availability of the verified deck. The process now waits until the second deck is removed (step 1265) from the card dispensing area 132 and the timer is started to await the insertion of the first deck into the card receiving area 130 after use in playing the game of cards. From this state, a weight for each verified deck of cards has been determined, and the determined weights used for subsequent verification of the decks of cards by weight alone so that a manual verification process is not performed except in the case where an error is detected.

In an aspect, the sequence of measured weights of each of the individual decks of cards or the average weight of a single card of the deck of cards may be used to form an average or some type of arithmetic mean or exponential mean value for each deck of cards, so as to accommodate slow changes in the properties of the cards over an extended period of time. The repetitive measurement of the "weight" value each time each individual deck of cards is shuffled provides a plurality of sequential measurements that may be subject to a mathematical algorithm such as a running mean value, an exponentially smoothed running average or other mathematical algorithm so as to represent a lower-noise estimate of the verification weight value with respect to a pair of sequential measurements of the particular deck. Another technique for estimating the verification-weight-value change over a time period may be a Kalman filter which may also take account of the amount of time that has elapsed between each determining each measured value.

A concern when using two decks of cards, and where separate calibrations are used for each deck is that the sequence of decks being processed may be interrupted. In an aspect, the time-out where a fault is declared when both decks are removed from the apparatus for even a short period of time, such as greater than about 6 seconds, should mitigate this risk and may be the value of the timer limit used in steps 1215 and 1240, above. Alternatively, for example, the shuffler 100 may indicate the deck (e.g., by color) to be inserted by illuminating a red button and a green button in alternate shuffling sequences, cueing the operator through an alphanumeric or graphical display, or the like.

In another example of the method, adapted to use a processor that does not have a floating point capability, consider a circumstance where each deck of cards comprises 52 cards, and a deck is considered to be verified if the measured value of weight is between 51.5 and 52.5 equivalent cards. A person of skill in the art will understand that, in the detailed implementation, consideration of rounding errors in the computation may be required.

A first deck of cards may be manually verified to ensure that the 52 cards are present prior to shuffling and placed in the card receiving area 130. At this time there would be no cards present in the card dispensing area 132. The button 410 may be pushed to initiate the shuffling sequence and the cover 104 closes. At this time there is are no card in the card dispensing area and thus the only weight measured by the scale 1300 is the "tare" weight. The tare weight (in arbitrary units) may be determined as the median value of a plurality of sequential measurements. This approach reduces the influence of an individual spurious measurement. For this method, each time the tare weight or the "gross" weight is determined, a median of 5 measurements is used as the "weight".

The "median" weight is determined by reading the output value of the ADC voltage of the load cell at least three times, for example. The numerical values are stored in an array and sorted in numerical order. The middle value of the plurality of measurement values is then used for the processing, and the remaining values are discarded. This is intended to filter out any inaccurate data measurements from being used by the algorithm. This method of determining the weight is used for every measurement of weight, whether it is the tare weight or the gross weight. Where the presence or absence of the deck is a criterion for the particular weight value, an optical sensor may be used to establish the state. If the state changes during the course of the measurement, then the weight determination is invalid and the operator may be alerted. Alternatively, since the median weight values when a deck of cards is present on the scale and the median weight when there is no deck of cards on a scale differs considerably, such a large difference in individual weight measurements may also be used to determine that an unexpected change in state has occurred. While typically, an odd number of measurements is used in determining the median value, the median value for an even number of measurements may be estimated by determining the two central values in the array and averaging them. However, it is simpler to use an odd number of measurements.

The cost of a processor that does not include a floating point hardware capability is lower and it may be beneficial to adapt the validation to use an approach where the computations can be performed in integer arithmetic to an accuracy sufficient to achieve the validation objective. One approach to the rounding of numerical results in integer arithmetic is to add half the pre-determined weight of a card to the calculations so that when the number of cards in the deck is determined by dividing the net measured weight by the pre-determined card weight, the net measured weight can vary between half a card weight greater than, or half a card weight less than the initialization weight for the deck that was used to determine the card weight, while producing a result that the number of cards in the deck of cards being measured remains equal to the number of cards in the manually verified deck of cards.

The representation of the output of the scale does not have to be treated as a standard weight measure, although the values measured are proportion to the force applied to the load cell. Any fixed offset is amalgamated in the measured tare "weight". The term weight is used herein as a generality rather than requiring a value calibrated to a known standard.

This algorithm may also be adapted to be performed on a floating point co-processor, as would be appreciated by a person of skill in the art.

Two decks are used in sequence to play the games of cards, and at least one deck of cards is within the shuffler to avoid interchanging the decks of cards. Methods of ensuring this sequence is adhered to have been previously described so that the measured weight of the specific deck of manually verified cards may be used to validate the correct deck of cards during the play of successive games of cards.

In another illustrative example, the method of verifying cards may be performed in two phases: an initial phase where the weight of a card of each of two decks of manually verified cards is determined; and, an operational phase where each deck of cards is shuffled and used to play a game of cards such that the unshuffled cards from the previous game of cards are in the shuffler and being shuffled and verified while the other deck of cards, that has been previously verified, is being used to play a game of cards. Subsuming the shuffling and verification process of the deck of cards not being used to play the game of cards in the time that the verified deck of cards is outside the shuffler and being used to play a game of cards contributes to the overall efficient of operation, where the efficiency may be measured by the number of games of cards that can be played during a fixed period of time.

Figure 15:
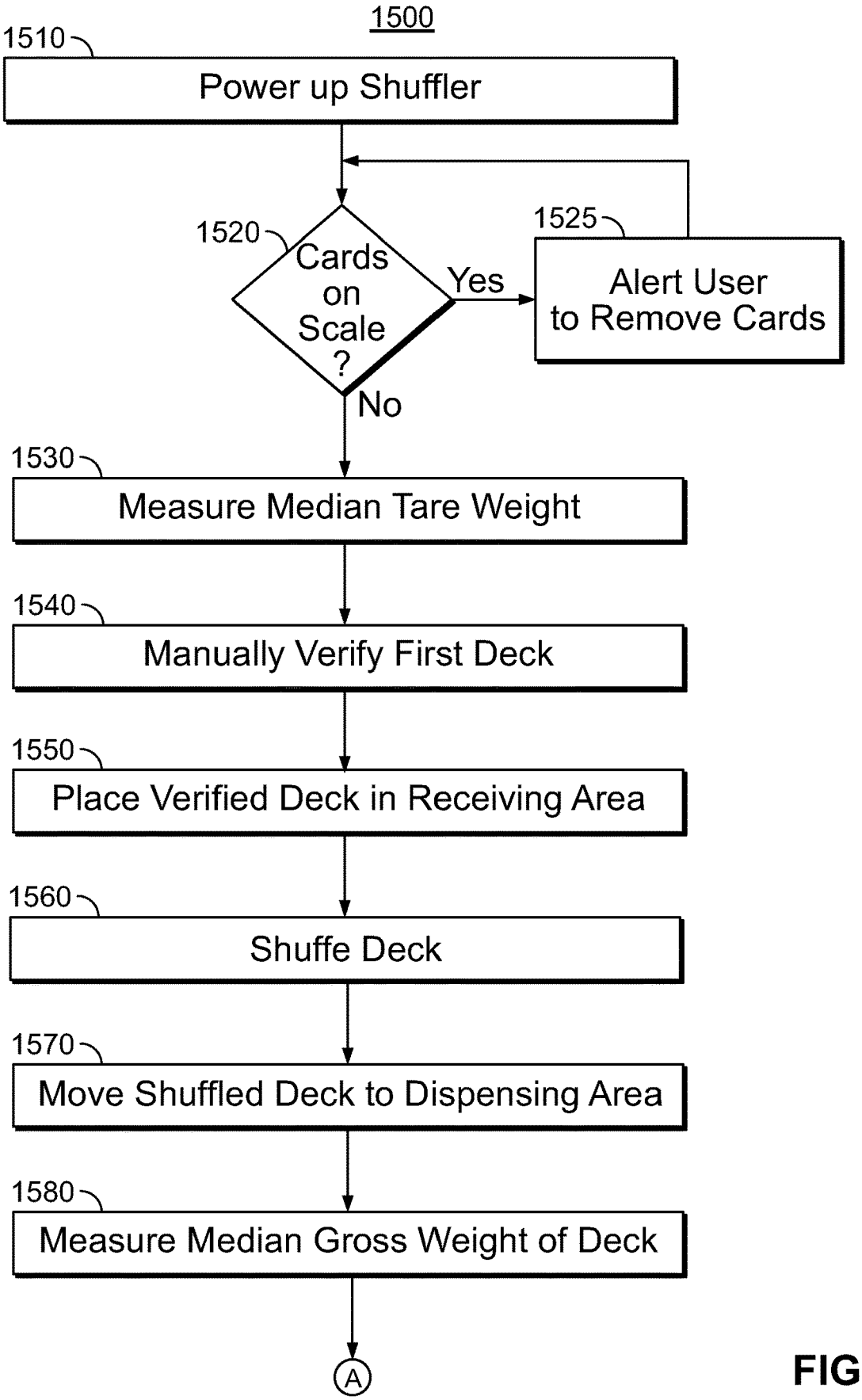
FIG. 15 is a detailed example of a method of initializing the shuffler for a configuration where two decks of cards are being used.
Figure 15:
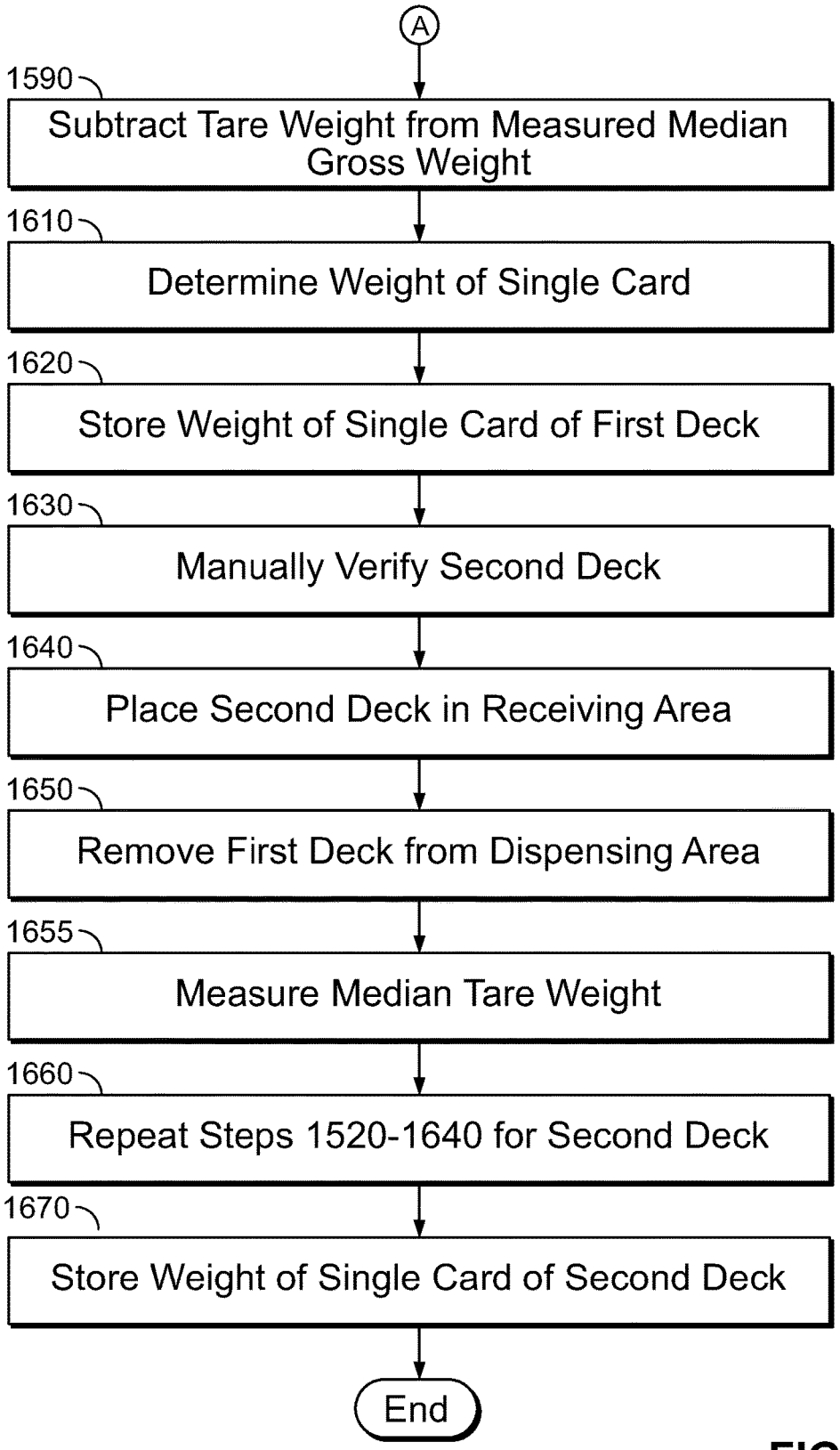

The initial phase 1500 (shown in FIG. 15) of the method may be initiated by a step of powering up the shuffler 1510. Alternatively, when the shuffler is being reinitialized, a sequence of the control buttons 410, 420 may perform the same function. There should be no cards in the card dispensing area 132 and this may be confirmed by the optical proximity sensor (step 1520). If a card is present, the user would be alerted (step 1525) and the process idled until there is no card present on the scale. At this juncture, the median value of the scale reading may be determined (step 1530) as the tare weight. The first deck of cards to be used may be manually verified (step 1540) as previously described and placed in the card receiving area 130. The shuffling operation may be performed (step 1560). For clarity, a step of moving the shuffled deck of cards from the shuffling compartment 150 to the card dispensing area is shown (step 1570). The presence of the deck of shuffled cards in the card dispensing area 132 would be determined, for example, using the optical proximity sensor 720 and the scale 610 used to measure the median gross weight of the shuffled deck of cards (step 1580). The median net weight of the manually verified deck of cards is determined (step 1590) by subtracting the weight determined (step 1530) from the weight determined in step 1580. The weight if a single card of the manually verified deck of cards is determined (step 1610) by dividing the value determined in step 1580 by the number of cards in the verified deck of cards. The weight of the single card of the manually verified deck of cards is stored (step 1620) in a memory 1050 of the shuffler 100 by the microprocessor 1300. This completes the initial phase of operation for the first of the two decks of cards to be used.

The second deck of cards needs to be manually verified (step 1630) and placed (step 1640) in the card receiving area 130. The first deck of cards is removed (step 1650) from the card dispensing area 132. At this juncture, optionally, the median value of the scale reading may be determined (step 1655) as the tare weight The shuffler is activated to perform the shuffling operation by performing steps 1510 through 1610 for the second deck of cards (step 1660) and storing the weight of the single card of the second manually verified deck of cards (step 1670) a in a memory 1050 of the shuffler 100 by the microprocessor 1300. The weight of the card of the first manually verified deck of cards and the weight of the card of the second manually verified deck of cards are presumed to be different weights and are used subsequently in the operational verification of the corresponding deck of cards of the two decks of cards. Note that the term "weight" is often used to represent a digital value that is proportional to weight of an object placed on the scale for convenience in description as a person would better understand the concepts. However there is no intent to require a calibrated weight as would be needed in a scale used for example for retail sales.

We have described the method of initialization as one which involves shuffling each deck of cards prior to determination of the weight of a card of the verified deck of cards. One could modify the method so that a first manually verified deck of cards was placed in the card dispensing compartment and the weight of a card determined and stored, followed by removing the first deck of cards from the card dispensing compartment and inserting the second deck of manually verified cards and the weight of a card of the second deck of cards determined and stored.

Figure 16:
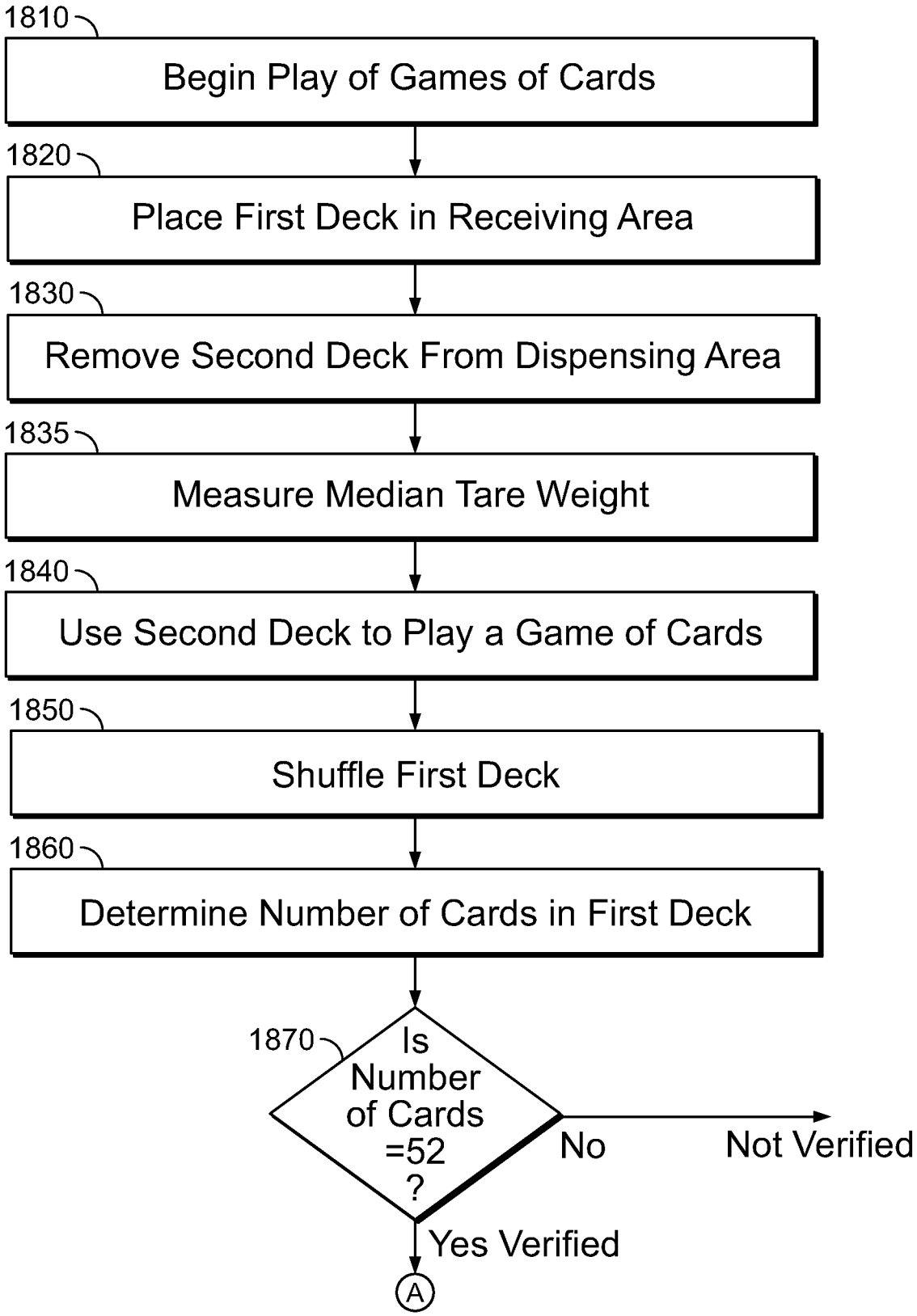
FIG. 16 is another example of a method of verifying the integrity of two decks of cards used sequentially in the play of successive games of cards.
Figure 16:
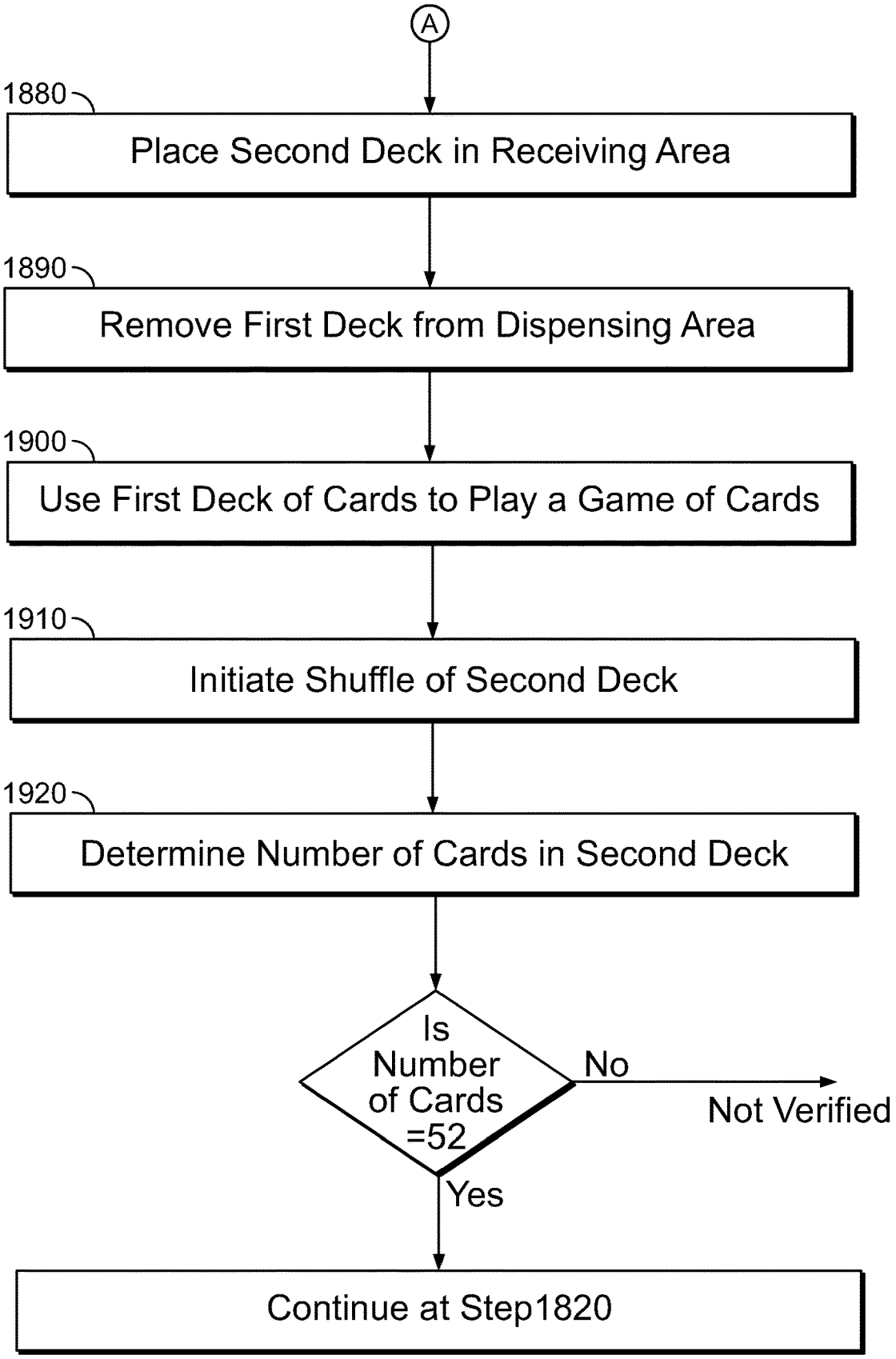

Once the initialization process has been successfully completed, the second deck of cards is present in the card dispensing area 132. The routine operation of the shuffler to support the dealer when administering a game such as poker is shown in FIG. 16. To begin using the deck of cards (step 1810) for play of a game of cards the first deck of cards, which is currently outside the shuffler 100 is placed on the card receiving area (step 1820) and the second deck of cards, which is the deck of cards in the card dispensing area is removed by the dealer (step 1830) and the second deck of cards is then used to begin playing a game of cards (step 1840). Optionally, the median value of the scale reading may be determined (step 1835) as the tare weight after the removal of the deck. Either before or after the start of playing the game of cards with the second deck of cards, the first deck of cards, which is present in the card receiving area has the shuffling operation initiated (step 1850.

The number of cards in the shuffled deck of cards is determined in step 1860 (which is described in further detail below). If the number of cards in the shuffled deck is equal to the expected number of cards (step 1870) the deck of cards is determined to be verified and the dealer would be permitted to remove the cards for play. Typically, at this stage the current game of cards is still being played, and the operation of the shuffled pauses to await further dealer action.

The process continues with the dealer placing the deck of cards used in playing the deck of cards (the second deck) in the card receiving area (step 1880) and removing the first deck of cards from the card dispensing area (step 1890) and beginning to use the first deck of cards to play another game of cards (step 1900). Optionally, the median value of the scale reading may be determined (step 1895) as the tare weight after the removal of the deck and before placing a new deck of cards in the card receiving area. Continuing with the sequence, the dealer would initiate a shuffling operation (step 1910) and verification operation (step 1920) as previously described. If the cards are verified, the dealer would be notified of the result (step 1930). This example has taken the operation through the use of the two decks of cards in a controlled manner to play two games of cards, returning the system to the state where the process may be resumed at step 1820 and continue as needed, except for any error situation.

Figure 17:
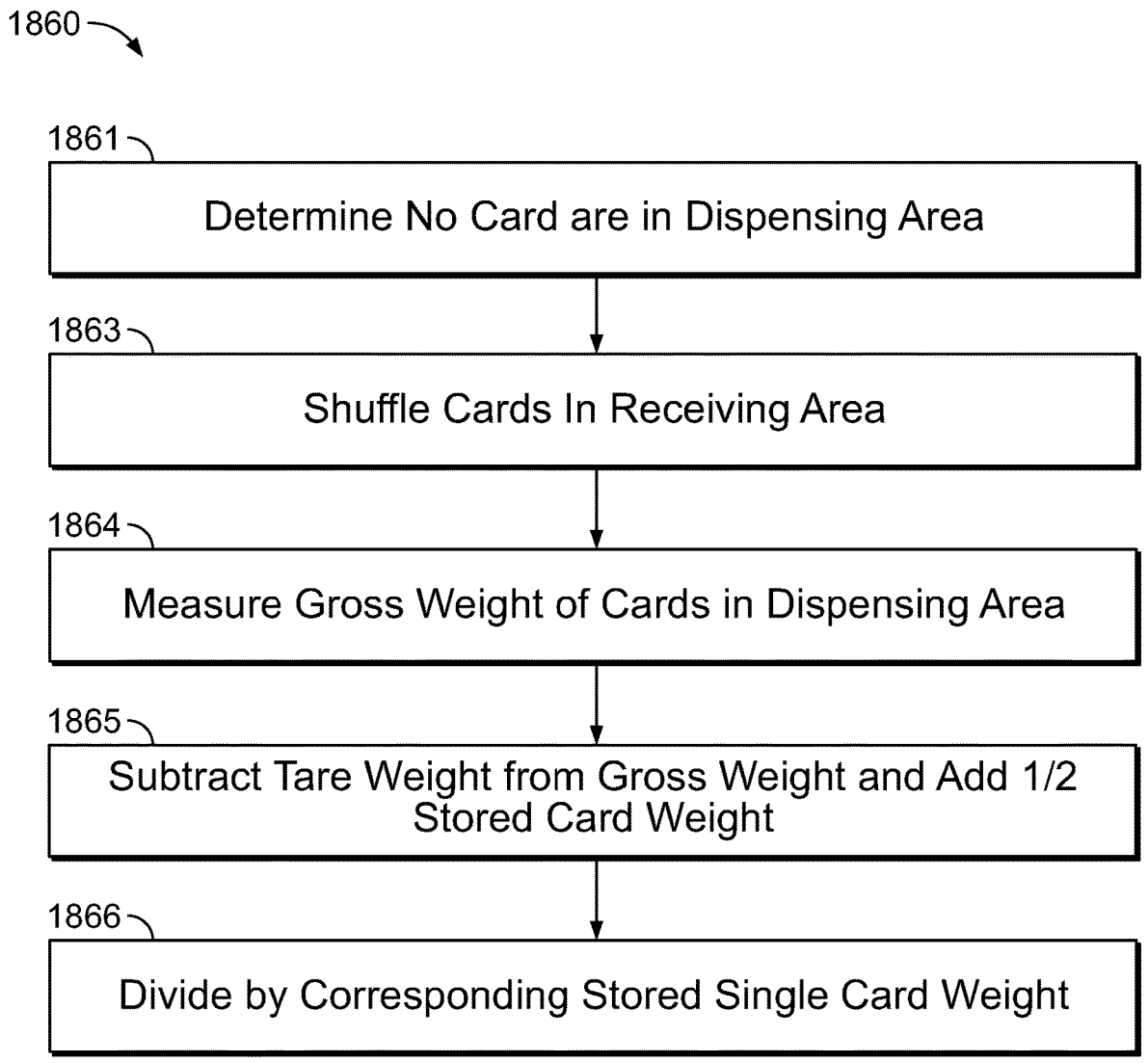
FIG. 17 is an example of a step of using the predetermined weight of a single card of a verified deck of cards to determine the number of cards in a shuffled deck of cards.

FIG. 17 is a more detailed explanation of an example of step 1860 for determining the number of cards in the deck of cards by the method 1800. The lack of cards in the card dispensing area is confirmed (step 1861). The tare weight changes slowly with time, and one may perform tare weight measurements once for a plurality of shuffling operations. This could also be initiated when a period of time has elapsed since the last tare weight measurement.

The cards in the card receiving area 130 may now be shuffled (step 1863) and moved to the card dispensing area 132. A median tare weight may be determined, as previously described prior to moving the cards to the card dispensing area where the median gross weight of the shuffled cards is determined (1864). The median tare weight is subtracted from the measured gross weight and half–the previously determined weight of a single card is added. The added weight of half a card takes account of the potential for drift in the measurements due to temperature, or the like. The median tare weight is added to half of the stored weight of a single card of corresponding deck of cards and the resultant is subtracted (step 1865) from the weight of the cards measured in step 1864. Then the resultant value is divided by the stored weight of a single card of the corresponding deck of cards (step 1866).

The result of step 1866 should equal the number of cards in a verified deck, which in the examples herein is 52. A person skill in the art would appreciate that the shuffler may be configured to use decks with more or less cards to accommodate the rules of other casino-type games which may include multiple decks of cards and one or more jokers.

The processor may be one which does not have a floating point processor as this is a less expensive component and uses integer arithmetic. In this circumstance, the computed numerical values are truncated. For example, if the result is 52.99, then a truncation rule may be to round the result to 52. Similarly, if the result is 52.5, the result would be 52. If the computation had been performed in floating point arithmetic (whether by algorithm or a floating point processor), the result may be rounded by truncation.

With the appropriate rounding function, the resultant will equal the number of cards in the manually verified deck of cards if there has been no change in the number of cards from the number of cards in the verified deck of cards used in the initial setup. Any other result will mean that the cards are not verified.

It will be understood that the above described arrangements of apparatus and the method of operation are merely illustrative of applications of the principles of this invention and many other embodiments and modifications may be made without departing from the spirit and scope of the invention as defined in the claims.

What is claimed is:

1. A system to prepare a deck of cards for play of a game of cards, comprising:

a shuffler that accepts a deck of unshuffled cards in a card deck receiving area, processes the deck of unshuffled cards to produce a shuffled deck of cards having a randomized sequence of cards and deposits the shuffled deck of cards in a card deck dispensing area; and, receives a first deck of cards and a second deck of cards and individually processes each deck of cards in sequence to produce a first shuffled deck of cards or a second shuffled deck of cards for use in successive games of cards;

the shuffler further including:

the card deck receiving area;

the card deck dispensing area;

a cover disposed over the card dispensing area;

a processor including a computer-readable memory; and a scale located in the card deck dispensing area and coupled to the processor to determine a measured weight of the first deck of cards or the second deck of cards in the card dispensing area, wherein a measured weight of the shuffled first deck of cards or the measured weight of the shuffled second deck of cards is used to determine a verification state of the shuffled first deck of cards or the shuffled second deck of cards, respectively; and, to open the cover to permit removal of the verified shuffled first deck of cards or the verified shuffled second deck of cards from the card deck dispensing area.

2. The system of claim 1, wherein the verification state of not verified notifies a user of a fault.

3. The system of claim 1, wherein a net weight of the deck of cards of the first or the second deck of cards is a measured weight of the first or the second deck of cards less a tare weight measured by the scale when the first deck of cards and the second deck of cards are not on the scale.

4. The system of claim 3, wherein a cut card is placed on the scale prior to shuffling the deck of cards.

5. The system of claim 3, wherein the tare weight includes a weight of a cut card.

6. The system of claim 1, wherein, a calibration weight of a single card of each of the first deck of deck of cards or the second deck of cards, respectively, is the net weight of a manually verified shuffled deck of cards divided by a whole number of cards in the manually verified shuffled deck of cards and the calibration weight of the single card is stored in the computer-readable memory for each of the first deck of cards or the second deck of cards, respectively.

7. The system of claim 6, wherein the processor selects between a verification state of verified and a verification state of not verified, where the verification state of verified is selected when a first condition is satisfied and the verification state of not verified is selected when a second condition is satisfied; and the first condition is that a difference between a quotient of the net weight of the shuffled deck of cards and the calibration weight of the single card of the deck of cards and a whole number of cards in a manually verified deck of cards is within a predetermined absolute numerical value; and, the second condition is that the difference between the quotient of the net weight of the deck of cards and the calibration weight of the single card of the deck of cards and a whole number of cards in the manually verified deck of cards is greater than or equal to the predetermined absolute numerical value.

8. The system of claim 7, wherein the predetermined absolute numerical value is one-half.

9. The system of claim 7, wherein the predetermined absolute numerical value is zero.

10. The system of claim 7, where the predetermined absolute numerical value is a fractional value less than unity.

11. The system of claim 2, wherein, a calibration weight of each of the first deck of deck of cards or the second deck of cards, respectively, is a net weight of a manually verified shuffled deck of cards; and the calibration weight is stored in the computer-readable memory for each of the first deck of cards or the second deck of cards, respectively.

12. The system of claim 1, wherein the processor selects between a verification state of verified and a verification state of not verified, where the verification state of verified is selected when a first condition is satisfied and the verification state of not verified is selected when a second condition is satisfied; and the first condition is that a difference between the net weight of the shuffled deck of cards and a calibration weight of the of the deck of cards is within a predetermined absolute numerical value; and, the second condition is that a difference between the net weight of the shuffled deck of cards and the calibration weight the deck of cards is greater or equal to the predetermined absolute numerical value.

13. The system of claim 12, wherein the predetermined absolute numerical value is one-half the weight of a single card of the deck of cards.

14. The system of claim 12 where the predetermined absolute value is a fractional value of the weight of a single card of a corresponding first deck or second deck of cards.

15. A card shuffler comprising: an electromechanical apparatus including a microprocessor and a computer readable memory, including:

a card input area, sized and dimensioned to receive a deck of cards that has previously been verified;

a card dispensing area, sized and shuffled deck of cards, wherein the apparatus is configured to determine a verified state of the shuffled deck of cards when a measured weight of the shuffled deck of cards in the card dispensing area compared with a deck of shuffled cards;

weight of the verified deck of cards indicates that a number of cards in the shuffled deck of cards is equal to a same number of cards in the verified deck of cards; and an openable cover disposed over at least the card dispensing area, the openable cover configured to permit removal of the shuffled deck of cards from the card dispensing area when the shuffled deck of cards is in the verified state, wherein two decks of cards are used to play games of cards and a first deck of shuffled and verified cards is used in a game of cards while a second deck of verified cards is being shuffled and verified.

16. The card shuffler of claim 15 wherein the means for verifying uses integer arithmetic for verification.

17. The card shuffler of claim 15 wherein the means for verifying uses floating point arithmetic.

18. A method of verifying decks of shuffled cards that have been previously manually verified, comprising:

providing a shuffler for randomizing a deck of playing cards for use in a game of cards, the shuffler being an electromechanical apparatus including a microprocessor and a computer readable memory;

the shuffler further comprising:

a card input area that is sized and dimensioned to accept the deck of playing cards;

a card shuffling area that randomizes the deck of playing cards; and, a card output area for receiving the randomized deck of playing cards;

an openable cover disposed over the card output area;

the card output area further comprising a scale for weighing cards, coupled to the microprocessor;

the method further comprising:

shuffling a first deck of cards and a second deck of cards sequentially, with each shuffled deck used for playing a game of cards, the step of processing of the deck of cards comprising:

receiving the deck of cards to be shuffled in the card input area;

determining that the card output area is void of cards;

randomizing the deck of cards in the card shuffling area and depositing the cards on the scale in the card output area;

determining a weight measured by the scale in the card output area; and verifying that a number of cards in the shuffled deck of playing cards in the card output area has not changed from a last time the deck of cards was shuffled, using the measured weight, prior to opening the openable cover.

19. The method of claim 18, wherein each of the first deck of cards and the second deck of cards is verified by visual inspection prior to being shuffled for a first time.

20. The method of claim 18, wherein determining the weight measured by the scale in the card output area comprises determining at least one of a median value, an arithmetic average value, a running arithmetic mean value, or an exponential values of a plurality of scale measurements.

21. The method of claim 18, wherein a cut card is used to avoid exposing of a bottom card of the deck of cards to view.

22. The method of claim 21, further comprising:

determining that the card output area is void;

waiting a predetermined period of time;

determining that the cut card is not present on the scale; and prompting a user to place the cut card on the scale, else, enabling the step of shuffling when the cut card is present on the scale and the deck of cards is present in the card input area.

23. The method of claim 22, wherein the step of determining that a cut card is present on the scale comprises:

providing an optical proximity sensor that determines if a card is present on the scale;

determining, using the optical proximity sensor that no cards are on the scale;

determining a first tare weight; or determining, using the optical proximity sensor that at least one card is present on the scale;

measuring a second tare weight; and, if a difference between the second tare weight and the first tare weight is approximately equal to a weight of a cut card, using the second tare weight as a tare weight.

24. A apparatus to prepare a deck of cards for play of a game of cards, comprising:

a processor including a computer-readable memory;

a card deck receiving area;

a card deck dispensing area;

a card shuffling mechanism;

an openable cover disposed over the card dispensing area whose state of open or closed is controlled by the processor;

a card shuffler mechanism that accepts a deck of unshuffled cards in a card deck receiving area, processes the deck of unshuffled cards to produce a shuffled deck of cards having a randomized sequence of cards and deposits the shuffled deck of cards in the card deck dispensing area;

a scale located in the card deck dispensing area and coupled to the processor; and the processor configured to determine a verification state of the shuffled deck of cards as one of verified or not verified based on a weight determined by the scale, wherein, when the verification state of the shuffled deck of cards is the verified state, the processor is further configured to permit the openable cover to be in an open state open so that the verified shuffled deck of cards is removable from the deck dispensing area.

* * * * *